US008944621B2

(12) United States Patent
Driver et al.

(10) Patent No.: US 8,944,621 B2
(45) Date of Patent: Feb. 3, 2015

(54) SHELF WITH LED ASSEMBLY

(75) Inventors: John Patrick Driver, Henryville, IN (US); Matthew McMillin, Palmyra, IN (US); Bradley M. Nall, Elizabethtown, IN (US); Jason Robert Yochum, Evansville, IN (US)

(73) Assignee: SSW Holding Company, Inc., Fort Smith, AR (US)

( * ) Notice: Subject to any disclaimer, the term of this patent is extended or adjusted under 35 U.S.C. 154(b) by 870 days.

(21) Appl. No.: 12/996,266

(22) PCT Filed: Jun. 4, 2009

(86) PCT No.: PCT/US2009/003405

§ 371 (c)(1),
(2), (4) Date: Mar. 23, 2011

(87) PCT Pub. No.: WO2009/148611

PCT Pub. Date: Dec. 10, 2009

(65) Prior Publication Data

US 2011/0164399 A1 Jul. 7, 2011

Related U.S. Application Data

(60) Provisional application No. 61/058,902, filed on Jun. 4, 2008, provisional application No. 61/090,002, filed on Aug. 19, 2008.

(51) Int. Cl.
*F21V 33/00* (2006.01)

(52) U.S. Cl.
USPC ..... 362/92; 362/249.05; 362/659

(58) Field of Classification Search
USPC ..... 362/92, 94, 125, 249.02, 249.04, 362/249.05, 249.12, 648, 652, 657, 658, 362/659
See application file for complete search history.

(56) References Cited

U.S. PATENT DOCUMENTS

| | | | | |
|---|---|---|---|---|
| 5,287,252 | A | 2/1994 | Caruso | |
| 5,403,083 | A | 4/1995 | Dasher | |
| 5,429,433 | A | 7/1995 | Bird | |
| 5,454,638 | A | 10/1995 | Bird | |
| 5,564,809 | A | 10/1996 | Kane | |
| 5,735,589 | A | 4/1998 | Herrmann | |
| 5,745,514 | A | 4/1998 | Patel | |
| 6,042,244 | A * | 3/2000 | Witkoski | 362/125 |
| 6,120,720 | A | 9/2000 | Meier | |
| 6,210,013 | B1 | 4/2001 | Bousfield | |
| 6,578,979 | B2 | 6/2003 | Truttmann-Battig | |
| 6,726,341 | B2 | 4/2004 | Pashley | |
| 6,786,562 | B2 | 9/2004 | Obrock | |
| 7,005,805 | B2 | 2/2006 | Ahn | |
| 7,080,920 | B2 | 7/2006 | Fitzsimmons | |
| 7,121,675 | B2 | 10/2006 | Ter-Hovhannisian | |
| 7,163,305 | B2 | 1/2007 | Bienick | |
| 7,210,808 | B2 | 5/2007 | Malpetti | |
| 7,273,299 | B2 | 9/2007 | Parkyn | |
| 2003/0038571 | A1 * | 2/2003 | Obrock et al. | 362/92 |

(Continued)

*Primary Examiner* — Y My Quach Lee
(74) *Attorney, Agent, or Firm* — Varnum, Riddering, Schmidt & Howlett LLP

(57) ABSTRACT

A shelving assembly (500) includes a pair of sheet metal sidearms (506) having ladder connectors (508) releasably coupled to cantilever ladders (504). An LED strip (520) having spaced apart LEDs is positioned immediately behind a refrigerator shelf (516). A rear form (522) is used for securing the LED strip (520) to a refrigerator shelf (516). The LED strip (520) is powered through electrical contact modules (524) which conductively connect to low voltage power strips (534).

19 Claims, 26 Drawing Sheets

(56) References Cited

U.S. PATENT DOCUMENTS

| | | | | |
|---|---|---|---|---|
| 2005/0093408 | A1 | 5/2005 | Koloff, Jr. | |
| 2006/0029808 | A1* | 2/2006 | Zhai et al. | 428/412 |
| 2006/0216476 | A1 | 9/2006 | Ganti | |
| 2007/0058369 | A1 | 3/2007 | Parkyn | |
| 2007/0075199 | A1* | 4/2007 | Stewart et al. | 362/92 |
| 2007/0104841 | A1 | 5/2007 | Min | |
| 2007/0109764 | A1 | 5/2007 | Bienick | |
| 2007/0127229 | A1 | 6/2007 | Lee | |
| 2007/0144196 | A1 | 6/2007 | Currie | |
| 2007/0151274 | A1 | 7/2007 | Roche | |
| 2007/0180843 | A1 | 8/2007 | Park | |
| 2007/0266723 | A1 | 11/2007 | Lee | |
| 2008/0037239 | A1 | 2/2008 | Thomas | |
| 2008/0043456 | A1 | 2/2008 | Bernardini | |
| 2008/0158858 | A1 | 7/2008 | Madireddi | |
| 2008/0186695 | A1 | 8/2008 | Awai | |
| 2008/0186696 | A1 | 8/2008 | Awai | |
| 2009/0021927 | A1* | 1/2009 | Hall et al. | 362/92 |

* cited by examiner

SHELF WITH LED ASSEMBLY

CROSS-REFERENCE TO RELATED APPLICATIONS

This application claim priority of U.S. Provisional Patent Application Ser. No. 61/058,902 filed Jun. 4, 2008, and U.S. Provisional Patent Application Ser. No. 61/090,002, filed Aug. 19, 2008.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The invention relates to shelving articles adapted for use in various environments and, more particularly, to shelving articles adapted for use in environments such as refrigerators, with the shelving articles assisting in providing a light source.

2. Background Art

Various types of prior art shelving have been developed for use in a number of environments. Along with this shelving, use is often made of support bracing. This support bracing and these shelving articles are often adapted for use in environments such as refrigerators, store fixtures, store displays, kitchen pantries and similar residential, commercial and industrial devices and interiors. In these environments, it is important to provide means for adequate support for the shelving articles.

For example, for various shelving articles in a number of different environments, it is known to employ stationary devices often referred to as "cantilever ladders." The cantilever ladders are typically fixed to a permanent wall of a room interior, a back wall of a refrigerator compartment or secured in similar environments. These cantilever ladders are often elongated in structure and may be mounted to the walls or other supporting structures through conventional means (such as screws, bolts and the like) in a vertical configuration. These ladders will often include a series of vertically disposed slots. These slots provide a means for releasably securing supporting devices to the cantilever ladders, with the supporting devices directly supporting shelving articles.

These supporting devices or braces are often referred to as "support brackets." These support brackets typically include formed latch mechanisms releasably securable within the slots of the cantilever ladders. These support brackets are also typically elongated in structure, and extend outwardly from the cantilever ladders. The reference to the term "cantilever" with respect to the ladders results from the fact that the supporting interconnection or "latching" between the ladders and the support brackets is often an interconnection where cantilever forces are exerted onto the ladders by the interconnection and structure of the support brackets, and the weight of articles supported by the brackets. The elongated portions of the support brackets are typically structured so as to support a shelving article in a horizontal or possibly angled orientation.

It is common for two or more support brackets to be utilized to support one shelving article. When the support brackets are located at or adjacent opposing lateral sides of the shelving article being supported, the support brackets are often referred to as "sideplates."

As earlier stated, numerous designs for shelving and supporting apparatus exist in the prior art. For example, Kene, et al., U.S. Pat. No. 5,564,809, issued Oct. 14, 1996, discloses an encapsulated shelf assembly with a shelf support supporting a panel. Herrmann, et al., U.S. Pat. No. 5,735,589, issued Apr. 7, 1998, discloses a shelf assembly for a refrigerator compartment. The assembly includes a member slidably movable for extension and retraction on a support. The shelf member includes slide members preferably molded as a rim on an article support surface. A guide member extends from one or both of the side members to guide the sliding movement. A stop on the guide member limits travel by engaging a limit surface on a shelf support.

Bird, et al., U.S. Pat. No. 5,454,638, issued Oct. 3, 1995, discloses adjustable refrigerator shelving having a shelf rail for supporting a partial width shelf within a refrigerator compartment. The shelf is supported on first and second spaced apart shelf tracks vertically oriented in the compartment. The shelf tracks releasably engage with a number of support brackets for cantilever support of one or more shelves at a plurality of vertically spaced locations. The shelf rail includes rearwardly projecting hooks at each of the two opposing ends, for releasable engagement with the shelf tracks. Locking tabs are included on the hooks to retain the shelf rails on the track. A rub strip is provided between the partial shelf and the shelf rail, along a top edge of the shelf rail.

Bird, et al., U.S. Pat. No. 5,429,433, issued Jul. 4, 1995, describes a refrigerator shelf adapted for containment of spills on the shelf. In one embodiment, the shelf is slidably mounted to allow horizontal extension of the shelf, with access to the rear portion of the shelf using slide guides molded into the rim along each side of the shelf. The shelf is cantilevered upon support brackets from the rear wall of a refrigerator, so as to allow air flow around the shelf sides. These support brackets are adapted to support the shelf at a plurality of vertical positions.

Meier, et al., U.S. Pat. No. 6,120,720, issued Sep. 19, 2000, discloses a method of manufacturing a shelf with a plastic edge. The glass panel is placed on a cavity of a mold, with the cavity having side cavity portions, each housing one of pair of shelf brackets.

The traditional supporting brackets or sideplates utilized as support for shelving articles often have certain disadvantages. For example, a number of known shelving systems comprise sideplates which are formed from solid pieces of stamped metal. These types of sideplates utilize a substantial amount of metal. Also, in view of the substantial amount of surface area, a corresponding amount of finishing material is required. In addition, the volume of stamped metal can be relatively heavy. Still further, sideplates formed of solid pieces of stamped metal often prohibit any substantial amount of light transmission or air flow around the sideplates that support shelving articles.

In addition to requiring various types of supports, it is also advantageous for interiors of refrigerators and the like to provide at least some type of light source. It is known to utilize LED's to provide light sources within many products. For example, appliances such as refrigerators can use LED's so as to provide a relatively lower cost energy source of light. In this regard, LED's can be utilized with refrigerator shelves. However, various types of light sources using LED's with refrigerator shelves have shown various disadvantages.

SUMMARY OF THE INVENTION

In accordance with the invention, a shelf assembly is adapted for use in a refrigerator and other articles. The shelf assembly includes a shelf and support means for supporting the shelf at a desired height. Securitng means are provided for securing the shelf to the support means. A first plurality of LEDs is positioned in proximity to the shelf. A power supply assembly is directly or indirectly conductively connected to the LEDs for supplying low voltage power to individual ones of the LEDs. In accordance with another aspect of the invention, the power supply assembly includes resilient means for permitting differing distances between components of the power supply assembly.

The power supply assembly includes a pair of electrical contact modules directly or indirectly conductively connected to the LEDs. A pair of low voltage power strips are also provided, with each of the power strips conductively abutting different ones of the electrical contact modules. The abutments of the power strips with different ones of the pair of electrical contact modules is provided through a pair of resilient components positioned between the power strips and the different ones of the pair of electrical contact modules. The resilient means can comprise a pair of spring-loaded noses which provide width tolerances between the power strips and the electrical contact modules. Further, the power strips can be located adjacent to, but separate from any components of the support means.

The first plurality of LEDs can be formed as an LED strip. The LED strip can be secured to a rear form. The strip and the form can be located adjacent a rear portion of the shelf.

The power supply assembly can include a pair of low voltage power strips. Each of the power strips can be vertically disposed and positioned on a rear portion of the refrigerator or other article. The power strips can be structured and configured so that an electrically conductive direct or indirect connection can be made between the low voltage power strips and the LEDs, independent of any particular height or level at which the shelf is supported by the support means. The shelf assembly can also include a superhydrophobic coating which can be placed on a portion of a surface of the shelf. In this manner, spillage of water or other liquid can be retained.

The support means can include a pair of cantilever ladders, having ladder notches. A pair of sidearms can be positioned on opposing sides of the refrigerator shelf. The sidearms can include rearwardly projecting ladder connectors adapted to be releasably secured into sets of the ladder notches. The securing means can include an adhesive for bonding the shelf to the sidearms.

The power supply assembly can include the electrical contact modules and module connectors coupled to the rear form. A set of conductive and spring-loaded noses can be positioned between the electrical contact modules and corresponding ones of the power strips. In this manner, an adjustment of distance can be provided between one of the electrical contact modules and a corresponding one of the power strips. The spring-loaded noses can extend laterally from corresponding ones of the electrical contact modules, toward opposing sides of the refrigerator or other article. Also, the spring-loaded noses can extend directly rearward from corresponding ones of the electrical contact modules, and abut rear faces of the low voltage power strips.

In accordance with another aspect, the shelf assembly can include a set of slide mechanisms for permitting the shelf to be moved between extended and retracted positions. The rear form and the LED power strip can be maintained stationary while the shelf is moved between the extended and retracted positions. The support means can include a pair of sheet metal sidearms. Alternatively, the support means can include a pair of wire sidearms.

BRIEF DESCRIPTION OF THE SEVERAL VIEWS OF THE DRAWING

The invention will now be described with respect to the drawings, in which.

DETAILED DESCRIPTION OF THE INVENTION

Figure 1:
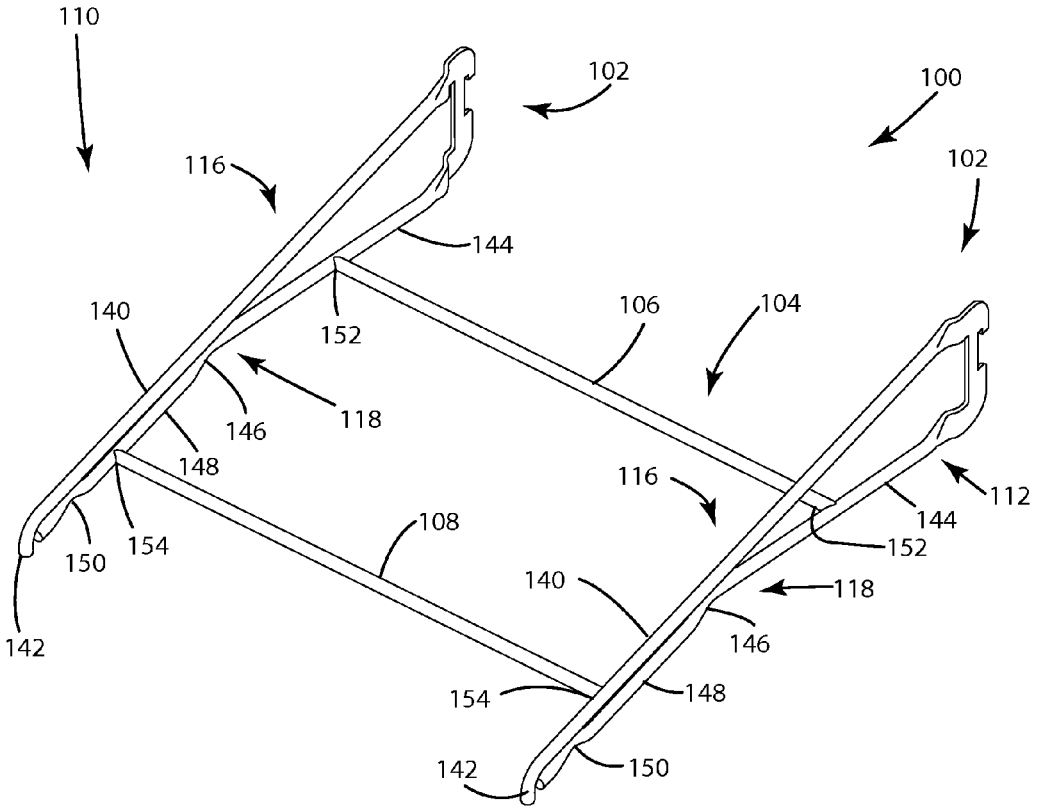
FIG. 1 is a perspective view of a prior art side plate assembly, illustrating a pair of sideplates interconnected to a pair of transverse support rods.

The principles of the invention are disclosed, by way of example, in certain embodiments of shelf assemblies using LED's for purposes of lighting, as illustrated in FIGS. 40-65. As described in subsequent paragraphs herein, the shelf assemblies can be adapted for use as refrigerator shelves, and utilize LED's to provide a relatively lower cost energy source of light. In part, shelf assemblies in accordance with the invention utilize a unique shelf support structure which houses an LED strip, with the storage surface of the shelf assembly utilizing glass, clear plastic or the like. The assembly can utilize a metal form which houses the LED strip. The metal form may be welded or otherwise secured to a pair of wire sidearms or a pair of traditional sheet metal sidearms. The LED strip can be fixedly attached to the metal form by various means, including adhesives, snap fittings and the like.

Shelf assemblies in accordance with the invention can be designed so as to be stationary or to otherwise provide slideout capability. With stationary embodiments, the metal form can act as a retention mechanism for the glass or plastic. Adhesives or other sealants may be utilized between the glass or clear plastic shelf, and the metal form. Also, adhesives or the like can be utilized to bond with the glass or clear plastic to the wire sidearms or sheet metal sidearms. With use in slideout configurations, adhesives can be utilized to bond the glass or clear plastic to a metal bracket on a slide member, or directly to the slide member which is incorporated within the shelf support structure.

Turning to the electrical portion of the shelf assemblies in accordance with the invention, the assemblies can utilize electrical contact modules which can be physically attached to the metal form by various means, such as adhesives, snap fittings and the like. The electrical contact modules, in turn, electrically connect to the LED strip. Correspondingly, the electrical contact modules can abut low voltage power strips that are located adjacent and separate from the cantilever track shelf supports or cantilever ladders. Such low voltage power strips can, for example, be fixedly attached to the rear wall of the refrigerator liner.

In accordance with certain aspects of the invention, the electrical contact modules facilitate overcoming width tolerance issues when the shelf support structure is placed in the transitional cantilever track shelf supports. The designs of the electrical contact modules allow for width tolerance, which assures appropriate abutment to the low voltage power strips. Spring loaded devices can be utilized within the modules, to facilitate providing this tolerance. Although various configurations can be utilized for the contact module in accordance with the invention, two separate embodiments are illustrated and described herein.

Still further, if desired, superhydrophobic treatment can be employed on the top surface of the glass or clear plastic, so as to provide for "spill-safe" features. Still further, with the particular configurations of the LED strips as described herein, relatively additional usable shelf space is provided, versus known types of shelving assemblies.

In accordance with various aspects of the invention, the shelf assemblies provide improved lighting within storage spaces. Further, relatively lower cost light sources are provided within the storage spaces, and the energy efficiency of the storage device (such as a refrigerator) is improved.

Still further, shelf assemblies in accordance with the invention provide relatively easier assembly than known configurations, and incorporate relatively less complicated design means within the LED shelves. As briefly noted earlier, in accordance with another aspect of the invention, relatively more usable shelf space is provided, and less material is consumed in constructing the shelving assemblies. Still further, and also as noted earlier, shelving assemblies in accordance with certain aspects of the invention allow for tolerance variation within the refrigerator liner and assembly operations. Still further, shelving assemblies in accordance with the invention are advantageous in that they can essentially be "retrofitted" into existing refrigerators. In this regard, existing cantilever track shelf supports or cantilever ladders do not have to be modified. As also mentioned earlier, if a superhydrophic feature is utilized, relatively more water is retained than that which is retained under existing configurations.

For purposes of providing a general background to shelving assemblies, various illustrative embodiments of shelving assemblies which have been previously developed by the assignee of this application will first be described with respect to FIGS. 1-39. Essentially, these drawings illustrate the use of wire sideplates with shelving assemblies. As described in subsequent paragraphs herein, the wire sideplates comprise single pieces of wire which are formed and then pressed or stamped so as to be releasably interconnected into a number of different types of cantilever ladders which are commonly used to support shelving systems in various environments. The wire sideplates employ relatively less steel than known shelving systems which typically utilize solid pieces of stamped metal as support brackets or sideplates for shelving assemblies. Still further, the wire sideplates require relatively less finishing material, in view of the reduction in surface area as compared to known support brackets or sideplates. Also, in view of the wire sideplates requiring less steel or other metals, the sideplates are of relatively lighter weight.

Still further, wire sideplates may be welded to support materials or shelving assemblies themselves, or may be plastic injection molded with the shelving assemblies, for purposes of providing additional strength and rigidity. In addition, wire sideplates may be folded or otherwise "collapsed" for efficient storage and shipping of shelving assemblies. Another advantage exists in that the configurations of the wire sideplates allow for substantially more light transmission and airflow then known sideplate configurations. Still further, wire sideplates may be utilized in a facilitative manner for purposes of providing either stationary or sliding movement of supported shelf assemblies. Still further, the wire sideplates lend themselves to use with wire support rods or similar additional supporting elements, for purposes of providing additional strength, support, rigidity and the like.

Turning to the drawings, the first embodiment of an assembly or frame utilizing wire sideplates is identified as wire sideplate frame 100, as illustrated in FIG. 1. The wire sideplate frame 100 illustrated in FIG. 1 employs a pair of opposing wire sideplates 102. For purposes of description, one of the wire sideplates 102 is identified in FIG. 1 as left hand wire sideplate 110, while the other is identified as right hand wire sideplate 112. The references to "left hand" and "right hand" are for purposes of identification only, and have no specific meaning with respect to concepts of the invention. As further illustrated in FIG. 1, the wire sideplates 102 are shown in opposing lateral positions, and are interconnected by a rear transverse support rod 106 and a front transverse support rod 108. For purposes of support and rigidity, the rear transverse support rod 106 may be interconnected to each of the wire sideplates 102 through weld points 152. Correspondingly, the front transverse support rod 108 may be connected to the front portion of each of the wire sideplates 110, 112 through weld points 154.

Figure 2:
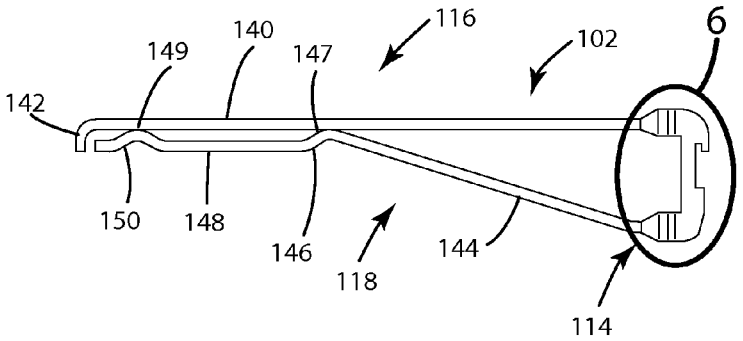
FIG. 2 is a side elevation view of one of the sideplates illustrated in FIG. 1.
Figure 3:
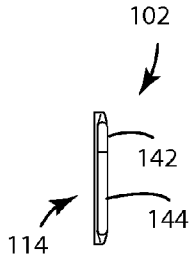
FIG. 3 is a front elevation view of the sideplate illustrated in FIG. 2.
Figure 8:
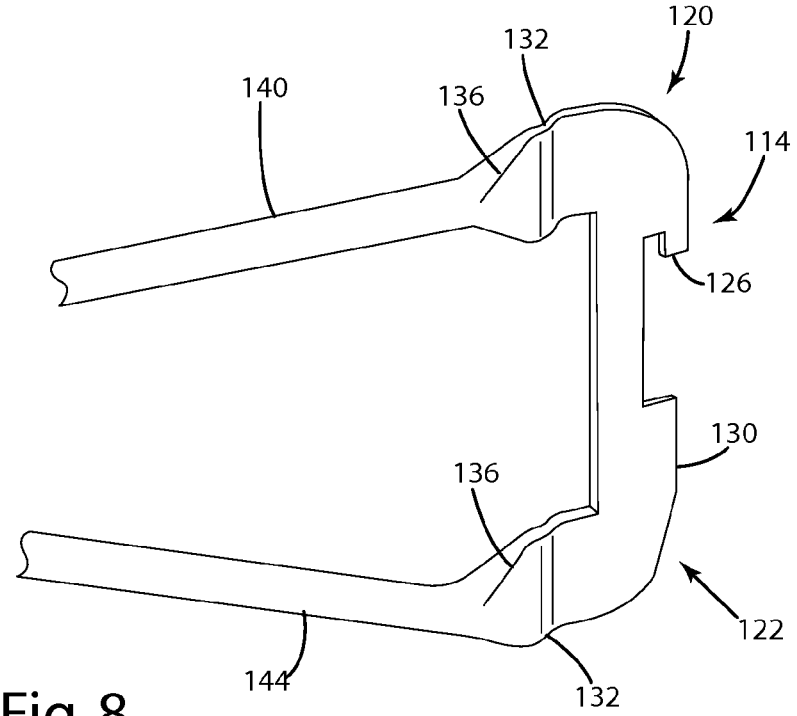
FIG. 8 is an enlarged view in perspective showing a ladder connector of one of the sideplates.

Details of one of the wire sideplates 102 further illustrated in FIGS. 2-8. With reference first to FIGS. 2 and 8, the wire sideplate 102 shown therein includes a rearwardly projecting ladder connector 114. The ladder connector 114 has a flattened configuration and, as will be described in greater detail herein, is adapted to releasably interconnect with conventional cantilever ladders traditionally used for shelf supports and the like. Extending forward from the rear ladder connector 114 is an upper sideplate arm 116, as shown in a number of the illustrations, including FIGS. 2, 4 and 5. In addition to the upper sideplate arm 116, a lower sideplate arm 118 also extends forward from the ladder connector 114. Details of the sideplate arms 116, 118 will be described in subsequent paragraphs herein.

Figure 6:
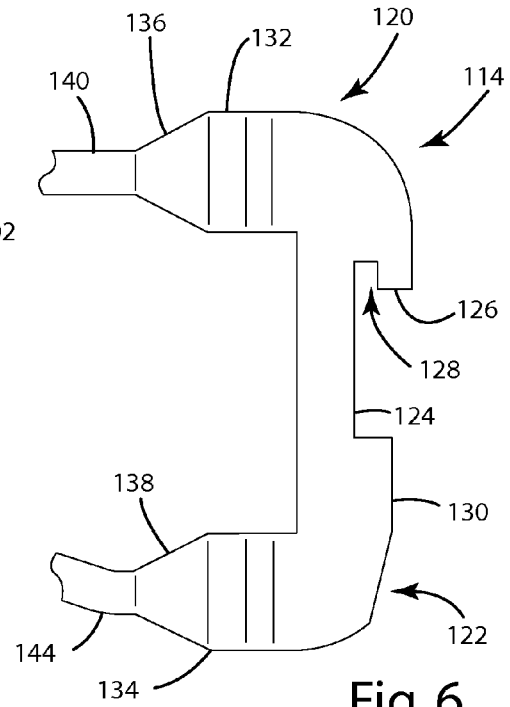
FIG. 6 is an enlarged view of the section identified in FIG. 2 by the circle 6, illustrating detail of the ladder connector of the sideplate.
Figure 7:
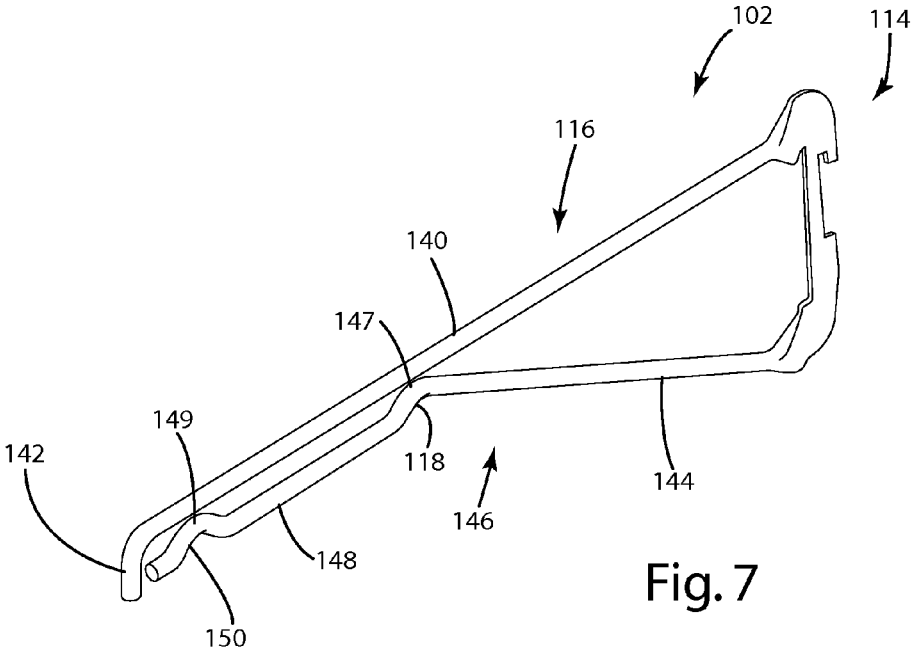
FIG. 7 is a perspective view of a single one of the sideplates illustrated in FIGS. 1-6.

Returning to the ladder connector 114, the connector 114 is shown in enlarged detail in FIG. 6. With reference thereto, the ladder connector 114 includes an upper connector bracket 120 and a corresponding lower connector bracket 122. As shown primarily in FIGS. 4 and 5, the ladder connector 114 may have an offset configuration relative to a plane formed by the elongated sideplate arms 116, 118. This offset configuration facilitates the releasable interconnection with the cantilever ladders.

In addition to the upper connector bracket 120 and lower connector bracket 122, the ladder connector 114 also includes an intermediate flange 124, having an elongated configuration and a vertically disposed orientation when the sideplate 102 is in use. The flange 124 is primarily illustrated in FIG. 6. Returning to the upper connector bracket 120, and as further shown in FIG. 6, the rear portion of the upper connector bracket 120 terminates in a downwardly projecting tongue 126. The tongue 126 is shaped and sized so as to form an undercut slot 128 between the tongue and the upper portion of the intermediate flange 124. When releasably connected to a cantilever ladder, the tongue 126 is designed so as to fit within a conventional slot of a known cantilever ladder. Further, the tongue 126 and the slot 128 are sized so that when the tongue 126 is fitted within a slot of a cantilever ladder, the tongue 126 (and the entirety of the sideplate 102) can be moved downwardly, so as to releasably engage the sideplate 102 with the cantilever ladder. With known cantilever ladders, this type of configuration prevents the sideplate 102 from being inadvertently released from the cantilever ladder. Instead, forces must be directed upwardly on the sideplate 102 so as to disengage the tongue 126 from the cantilever ladder.

Further, the lower connector bracket 122 includes a tab section 130 at the top portion thereof. The tab also has a vertical orientation and, like the tongue 126, is adapted to fit within a slot of a conventional cantilever ladder. It is the interconnections of the tongue 126 and the tab 130 within the slots of the cantilever ladder which provide for releasable interconnection and support of the wire sideplate 102 on the cantilever ladder. As clear from this configuration, when the wire sideplate 102 supports weight on its extended support arms 116, 118, such weight will exert cantilever forces on the cantilever ladder through the connections of the tongue 126 and tab 130. Also, it should be noted that other ladder connectors having structures and configurations different from ladder connector 114 may be utilized.

Figure 4:
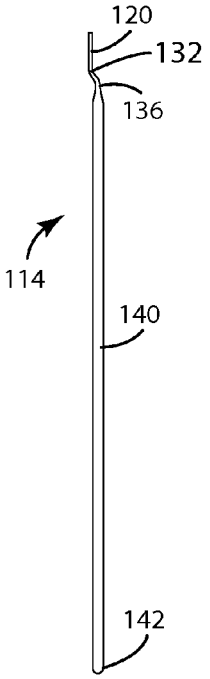
FIG. 4 is a plan view of the sideplate illustrated in FIG. 2.
Figure 5:
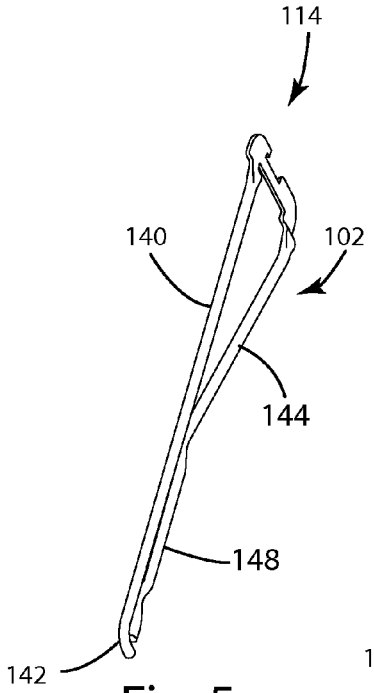
FIG. 5 is a downwardly projecting perspective view of the sideplate illustrated in FIG. 2.

Extending forwardly from the upper connector bracket 120 is an upper angled portion 132, shown in FIGS. 4, 6 and 8. The upper angled portion 132 extends from the bracket 120 to an upper reverse taper section 136. The section 136 is integral with the upper sideplate arm 116. It should be emphasized at this point, and throughout the specification, that although the wire sideplate 102 is described with respect to individual elements, the sideplate 102 is actually formed from a single wire composed of steel or other appropriate components. In this regard, the ladder connector 114 is actually formed and stamped so as to have a flattened configuration. However, the relationship between the upper angled portion 132, section 136 and arm 116 is one where all elements are integral with adjacent elements. That is, these and all other elements of the wire sideplate 102 are formed (and remain) as a single steel (or other material) component.

Extending forward from the lower connector bracket is a lower angled portion 134 having an angled configuration as primarily shown in FIGS. 6 and 8. The lower angled portion 134 extends from the lower connector bracket 122 to a lower reverse taper section 138. The lower reverse taper section 138 is integral with an upwardly angled extension 144 of the lower sideplate arm 118. As shown primarily in FIG. 2, the upwardly angled extension 144 extends upwardly and is integral at its termination with a first curved section 146. The first curved section 146 is integral and intermediate the upwardly angled extension 144 and a horizontal extension 148. At the forward portion of the horizontal extension 148 is an integral second curved section 150. The second curved section 150 terminates in a position immediately below and slightly behind a terminating end of the upper sideplate arm 116. If desired, the lower sideplate arm 118 can be welded to the upper sideplate arm 116 at various locations, for purposes of providing additional rigidity of the sideplate 102. For example, the first curved section 146 of the lower arm 118 could be welded or otherwise secured to upper arm 116 at weld point 147 shown in FIG. 2. Correspondingly, the second curved section 150 of the lower arm 118 could be welded or otherwise secured to upper arm 116 at weld point 149 as also shown in FIG. 2. Again, these weld connections provide additional rigidity.

Returning to the upper portions of the wire sideplate 102, the upper angled portion 132 is integral with and extends between the upper connector bracket 120 and the upper reverse taper 136. The angled and tapered configuration of the upper angled portion 132 and upper reverse taper 136 are primarily shown in FIG. 8. At the forward end of the upper reverse taper 136, a forward extension 140 of the upper sideplate arm 116 is integrally formed. The forward extension 140 extends forwardly from the ladder connector 114 and terminates in a downwardly projecting lip 142, as primarily shown in FIG. 2.

The foregoing has described a wire sideplate frame or assembly 100, utilizing a pair of wire sideplates 102. As apparent from this description, each of the wire sideplates 102 used in the frame 100 illustrated in FIG. 1 can be identical to the other.

Figure 9:
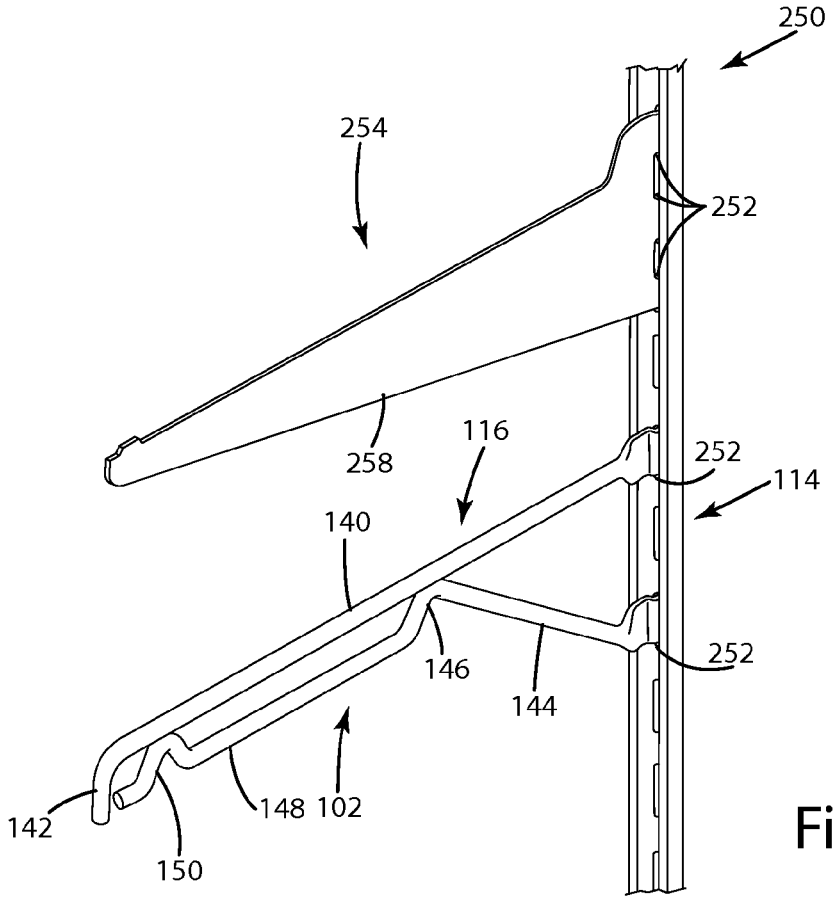
FIG. 9 is a perspective view showing one of the sideplates in accordance with the invention connected to a vertical ladder strip, and also shows a prior art sideplate as connected to the same vertical ladder strip.

As earlier stated, a number of known shelving systems comprise sideplates which are formed from solid pieces of stamped metal. To clarify the comparison between such prior art sideplates and wire sideplates, FIG. 9 illustrates both types of sideplates as releasably secured to a conventional cantilever ladder. More specifically, FIG. 9 illustrates a conventional cantilever ladder or strip 250. The conventional cantilever ladder 250 is well known in the shelving arts and may be secured to a wall, refrigerator interior or numerous other surfaces where cantilever shelving is desired. The conventional cantilever ladder 250 normally has a vertical orientation and includes a series of slots 252 located at spaced apart intervals along the ladder 250. At the top of the cantilever ladder 250 as illustrated in FIG. 9 is a prior art sideplate 254. This type of sideplate is well known in the shelving industry, and typically comprises a solid piece of steel or other metallic components. This solid piece of steel or other metallic components forms a connector ladder 256 and a solid extension piece 258 projecting forwardly from the solid connector ladder 256. In contrast, and as further shown in FIG. 9, a wire sideplate 102 is illustrated. This sideplate corresponds to the sideplate previously described with respect to FIGS. 2-8. As apparent from FIG. 9, the wire sideplate 102 utilizes substantially less metal than does the prior art sideplate 254.

Figure 10:
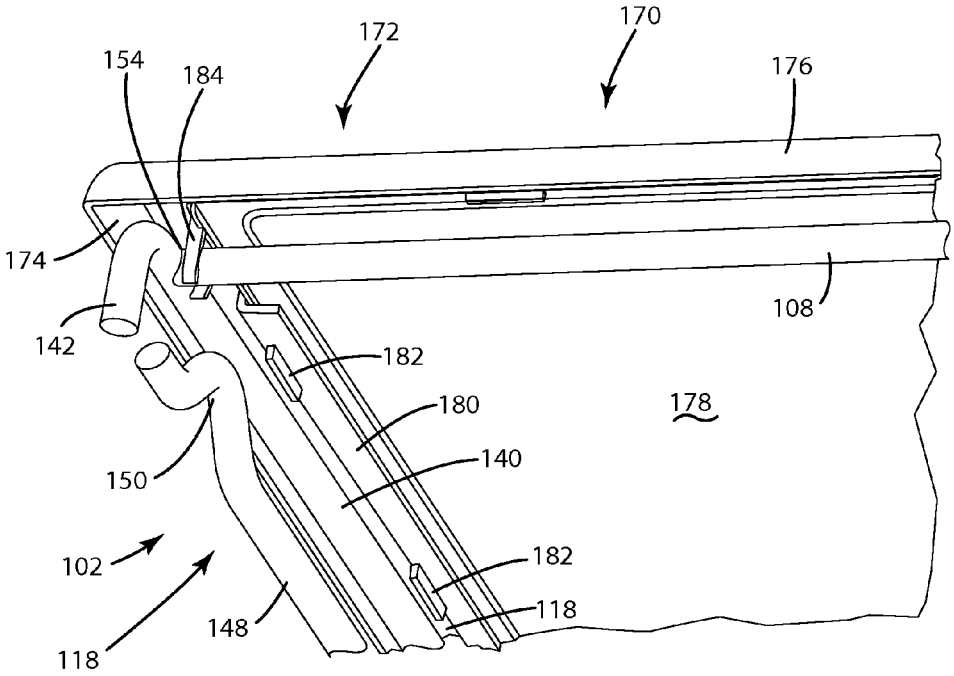
FIG. 10 is a perspective view of a front corner interconnection of a sideplate with a shelf assembly.

FIG. 10 illustrates, as an underside perspective view, one corner of a shelf assembly 170 utilizing a wire sideplate frame having a pair of wire sideplates 102 (only one of which is partially shown in FIG. 10). In contrast to other versions of shelf assemblies described herein for use with wire sideplates, the shelf assembly 170 can be characterized as a "fixed" shelf assembly, in that the shelf frame 172 is fixed in position relative to the wire sideplates 102, and there is no sliding engagement therebetween. More specifically, the shelf assembly 170 includes the shelf frame 172 having sides 174 (one of which is shown in FIG. 10) and a front portion 176. A shelf surface 178 can be secured in a suitable manner to the shelf frame 172. There are several known methods for securing the surface 178 to the frame 172. For example, one such procedure is disclosed in U.S. patent application Ser. No. 10/375,632, entitled ADHESIVELY BONDED, LEAK-PROOF SHELF filed Feb. 27, 2003. In the particular configuration illustrated in FIG. 10, the shelf frame 172 may be composed of a plastic material, and the shelf surface 178 may be composed of a glass material.

Still referring to FIG. 10, the portion of the sideplate 102 shown therein includes the forward extension 140 of the upper sideplate arm 116, the horizontal extension 148 of the lower sideplate arm 118, and the second curved section 150 of the lower sideplate arm 118. In addition, a front transverse support rod 108 is shown in part, and is connected to the upper sideplate arm 116 at weld point 154. In addition to the foregoing elements, which have been previously described herein, the view of the shelf assembly 170 in FIG. 10 also shows a specific means for coupling this portion of the wire sideplate 102 to the shelf assembly 170. Specifically, a support rod clamp 184 is shown as extending downwardly from the underside of the frame 172. Preferably, the clamp 184 may be formed of a plastic material or otherwise be resilient in nature. The clamp 184 is sized so that forces can be exerted to cause the front transverse support rod 108 to be captured within the clamp 184, in the position shown in FIG. 10. In this position, the clamp 184 acts so as to secure the transverse support rod 108 and the interconnected wire sideplate 102 to the shelf assembly 170 in a supporting manner. Again, it should be noted that with this type of connection, the position of the shelf assembly 184 is fixed, relative to the wire sideplates 102.

In addition to the foregoing elements, FIG. 10 also illustrates the use of channel guides 182. The channels 182 project downwardly. The channel guides 182 can be integral with or otherwise connected to the shelf frame 172 in any desired manner. The channel guides 182 can be utilized to essentially form a channel between the outside of the shelf frame 172 and the channel guides 182, with the forward extension 140 being positioned within the formed channel. In this manner, the channel guides 182 facilitate maintaining of stability of the wire sideplate frame 100 relative to the shelf assembly 170. Also, the channel guides 182 are particularly useful in maintaining stability of shelving assemblies on wire sideplate frames when the shelf assemblies are adapted to slide on the sideplate frames.

Figure 11:
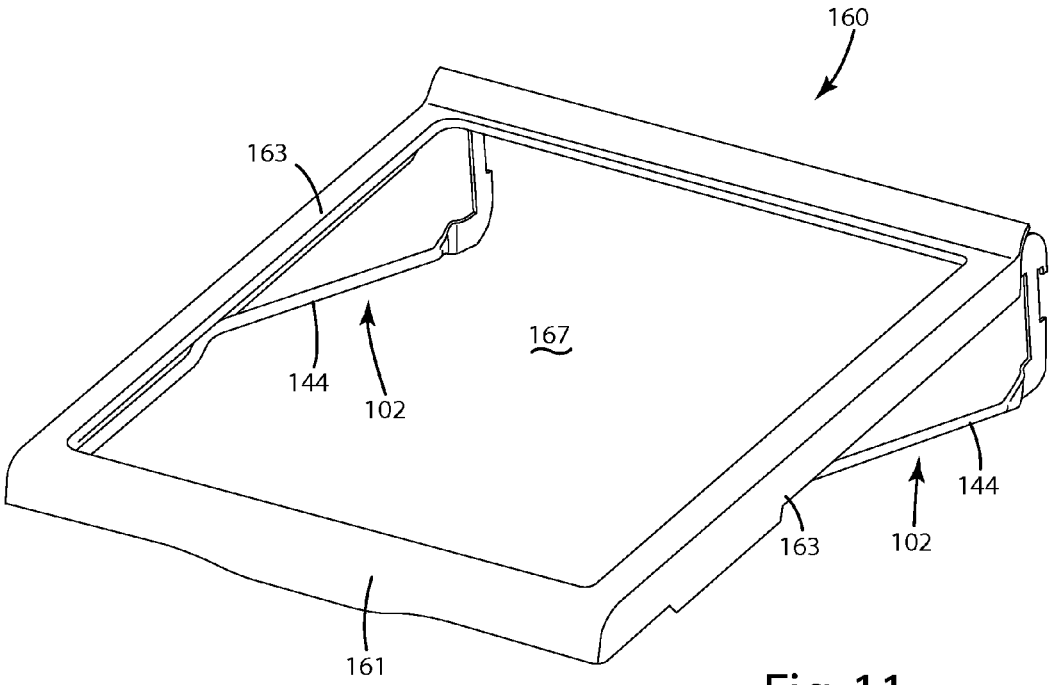
FIG. 11 is a perspective view of a glass shelf assembly mounted on a sideplate assembly, with the interconnection of the sideplate assembly with the shelf assembly having the capability of being folded under.
Figure 12:
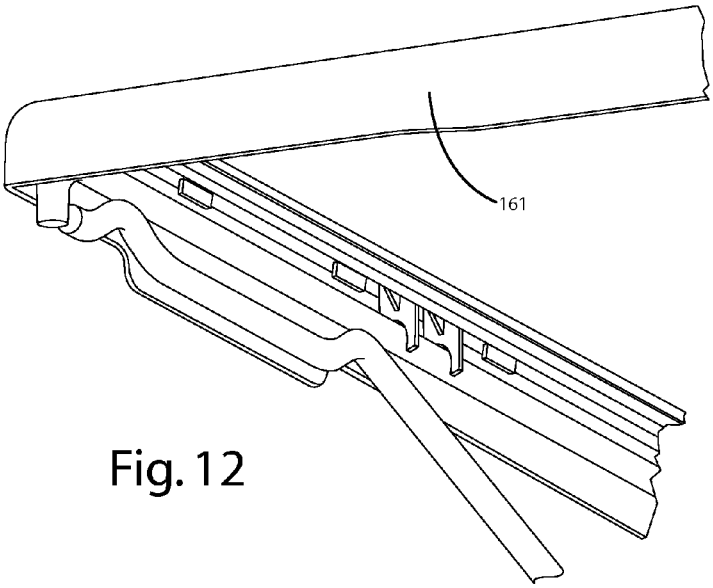
FIG. 12 is an enlarged, perspective view of a corner interconnection of one of the sideplates and the glass shelf assembly illustrated in FIG. 12.
Figure 13:
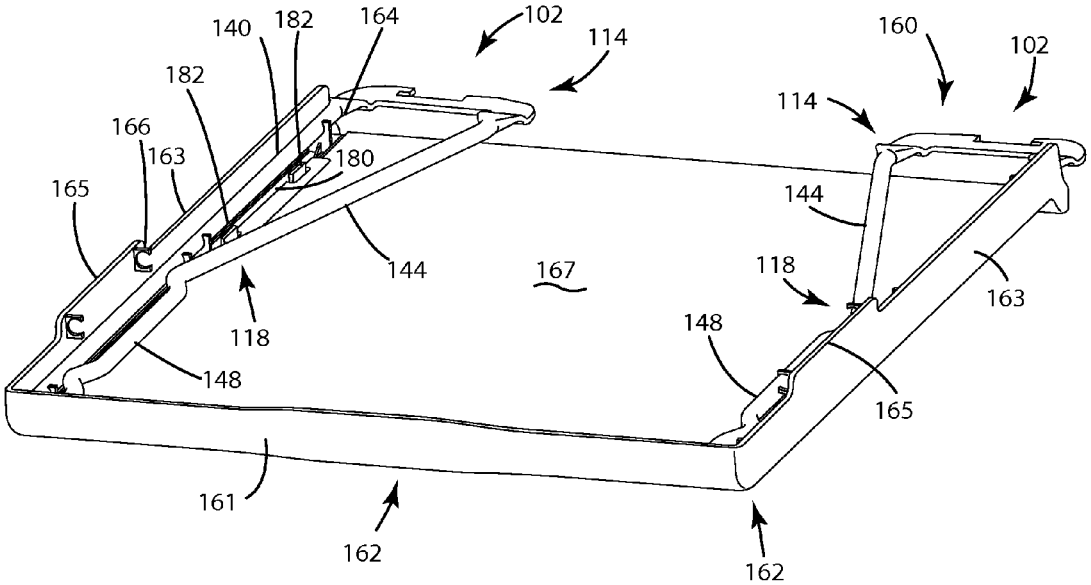
FIG. 13 is an underside, perspective view of the shelf assembly and the sideplate assembly shown in FIG. 12, utilizing two sideplates, and illustrating the sideplates as being "rolled under" or otherwise "folded under" the interconnected shelf assembly.
Figure 14:
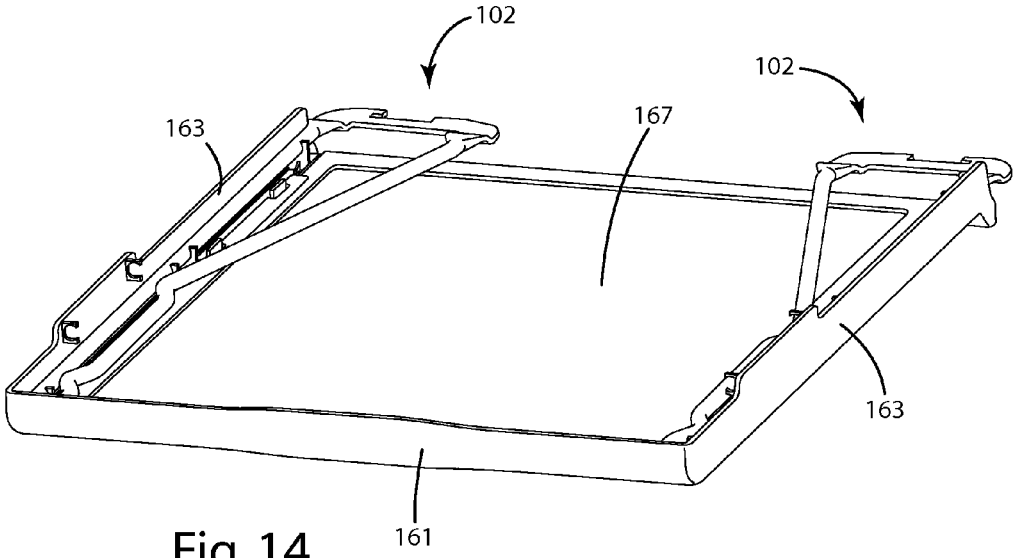
FIG. 14 is a perspective view similar to FIG. 14, illustrating the two sideplates of the sideplate assembly being in a "folded under" configuration.
Figure 15:
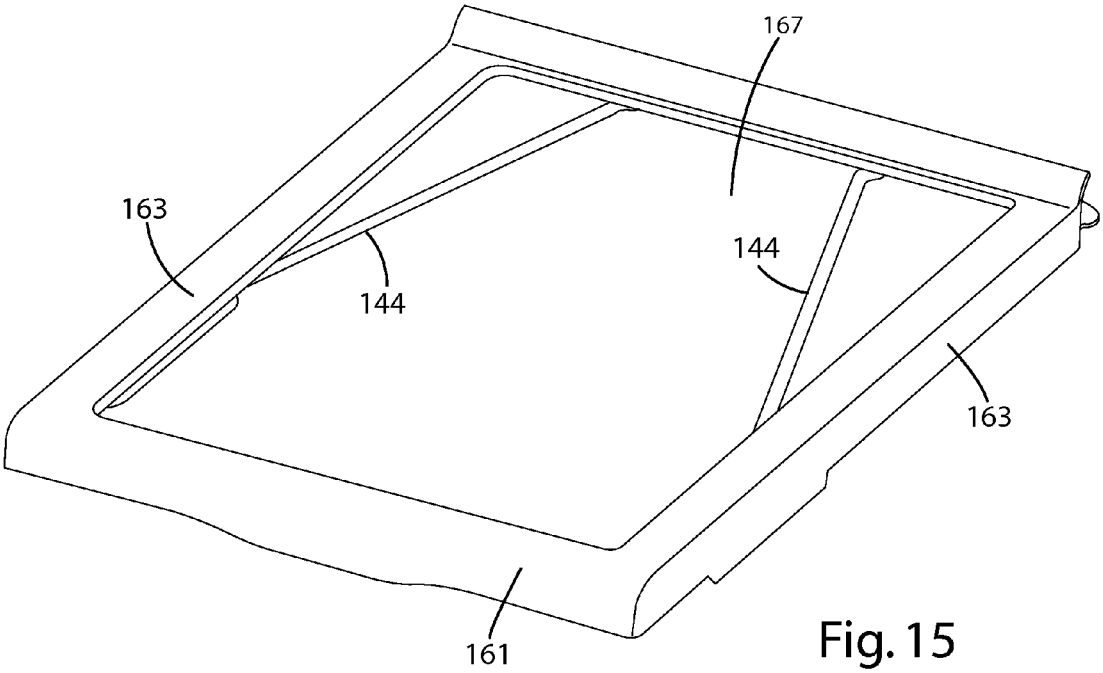
FIG. 15 is a perspective, upside view of the sideplates and shelf assembly shown in FIGS. 13 and 14, in a "folded under" configuration.

As earlier stated, one of the advantages of the use of wire sideplates is that they may be configured in shelving assemblies such that the sideplates can be "folded" or otherwise "collapsed" for efficient storage and shipping. One such embodiment is illustrated in FIGS. 11-15. FIG. 11 is a perspective view of a "roll under" shelf assembly 160. FIG. 12 is an underside perspective view of one corner section of the shelf assembly 160, showing the relationship between one of the wire sideplates 102 and other elements of the shelf assembly 160. FIG. 12 also shows the wire sideplate 102 when the shelf assembly 170 is in a "unfolded" configuration. FIG. 13 is an underside perspective view illustrating the relative positioning of the wire sideplates 102 with other components of the shelf assembly 160 when the sideplates 102 are in a folded configuration. FIG. 14 is similar to FIG. 13, while FIG. 15 is a conventional perspective view of the shelf assembly 160, when the wire sideplates 102 are in a folded configuration.

Turning specifically to FIGS. 11-15, the shelf assembly 160 includes a shelf 162. The shelf 162 includes a pair of opposing sides 163 and a front portion 161. The shelf 162 also includes a shelf surface 167.

As further shown in FIG. 13, the shelf assembly 160 includes a pair of wire sideplates 102 positioned on opposing lateral sides 163 of the shelf 162. The wire sideplates 102 correspond in structure and function to the wire sideplate 102 illustrated with respect to FIG. 2. As further shown, on the inside of the sides 163 of the shelf 162 are sets of upper clamps 164. These clamps 164 may be somewhat resilient in structure and are positioned and sized so as to securely receive the forward extension 140 of the upper sideplate arms 116 of both wire sideplates 102. Correspondingly, each of the sides 163 of the shelf 162 also includes a tab 165 positioned adjacent the forward portion of the shelf assembly 160 and extending downwardly. As further shown in FIGS. 12 and 13, on the inside of each of the tabs 165 is a pair of lower clamps 166. The clamps 166 maybe resilient in structure and are sized so as to releasably secure the horizontal extension 148 of each of the lower sideplate arms 118 of a corresponding wire sideplate 102. In addition to the foregoing elements, the shelf assembly 160 can also include, as shown in FIGS. 12, 13 and 14, channel guides 180, with a series of tabs projecting downwardly therefrom. The channel guides 180 act in the same manner as those previously described with respect to the shelf assembly 170 shown in FIG. 10. That is, they serve to maintain the forward extensions 140 positioned within channels formed by the channel guides 180 and other portions of the shelf frame 162. In this manner, relatively greater stability is provided for support of the shelf assembly 160 on the wire sideplate frame 100.

When the shelf assembly 160 is being used to support various items, the wire sideplates 102 are interconnected to cantilever ladders (not shown) in the manner previously described herein. Further, the horizontal extensions 148 of each of the wire sideplates 102 will be releasably secured within the lower clamps 166 on each tab 165 of the sides 163 of the shelf 162. However, when it is desired to store or ship the shelf assembly 160, each of the wire sideplates 102 can be "rotated" about a longitudinal axis extending through each of the forward extensions 140 of the corresponding wire sideplate 102. If the wire sideplates 102 are rotated inwardly toward the center of the shelf surface 167, they are essentially "collapsed" against the shelf surface 167. This configuration is illustrated in FIGS. 13, 14 and 15. In this configuration, storage and shipping of the shelf assembly 160 is clearly facilitated.

Figure 16:
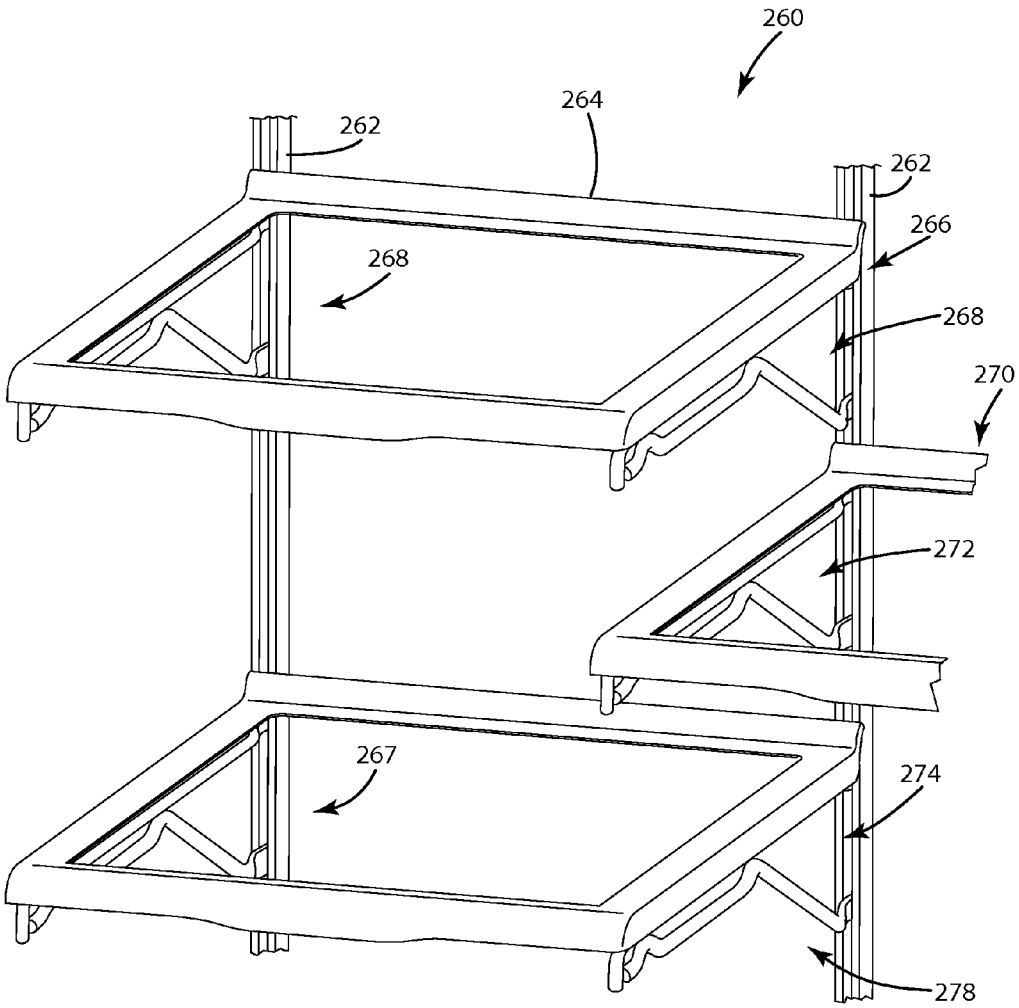
FIG. 16 is a perspective view of the use of sideplates in accordance with the invention, with a series of three shelf assemblies.

FIG. 16 illustrates an example shelving and sideplate assembly 260, where multiple shelves are employed. In this configuration, a pair of cantilever ladders or tracks 262 are illustrated as being attached to a back wall of a display case, refrigerator interior or other type of vertical supporting surface. The cantilever ladders or tracks 262 are conventional in design, as previously described herein.

With reference specifically to FIG. 16, a first shelf assembly 266 is shown as being connected to the pair of cantilever ladders 262 through a supporting pair of first wire sideplates 268. The first wire sideplates 268 correspond to the wire sideplates 102 previously described herein. The first shelf assembly 266 can correspond to a number of different types of known shelf assemblies, including the shelf assembly 170 previously described herein. As further shown in FIG. 16, the first shelf assembly 266 does not include any transverse support rods. Accordingly, the shelf assembly 266 may be utilized with the pair of wire sideplates 268 with a "roll under" capability.

Below the first shelf assembly 266, and offset to one side thereof, is a second shelf assembly 270, partially shown in FIG. 16. The shelf assembly 270, like the first shelf assembly 266, can be supported by a second pair of wire sideplates 272, only one of which is shown in FIG. 16. The wire sideplates 272 can correspond to the first pair of wire sideplates 268. It is apparent from the foregoing description that the side of the second shelf assembly 270 which is not shown in FIG. 16 would be supported by the second one of the pair of wire sideplates 272, with the second one of the wire sideplates 272 being releasably secured to a further cantilever ladder (not shown).

In the FIG. 16 configuration, a third shelf assembly 274 is shown mounted to the connector ladders 262 directly below the first shelf assembly 266. The third shelf assembly 274 is supported on the cantilever ladders 262 through a third pair of wire sideplates 276. In this particular instance, all of the wire sideplates 268, 272 and 276 can be identical to each other.

Figure 17:
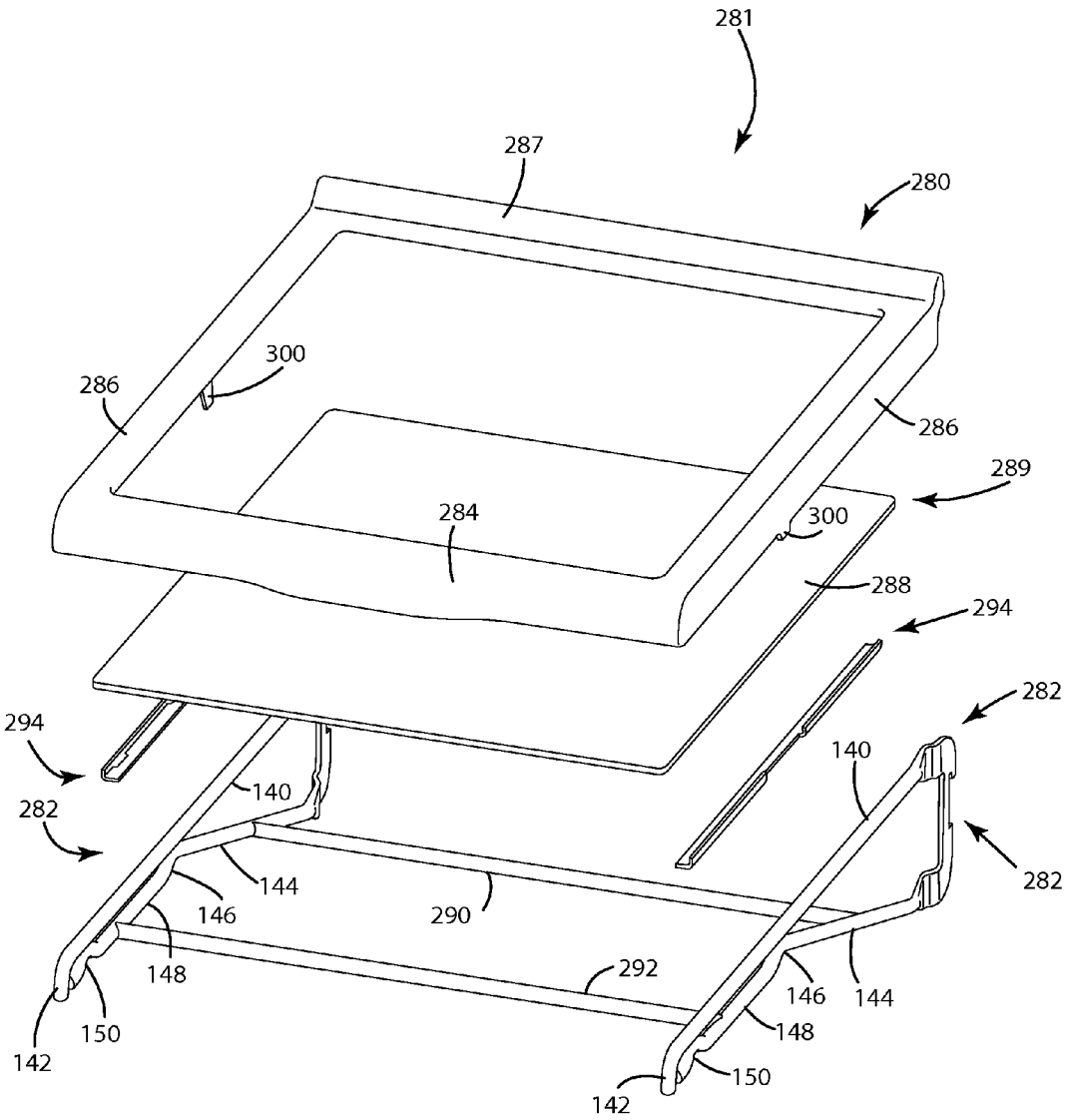
FIG. 17 is an exploded view of a glass shelf assembly for use in a slidable configuration with a pair of wire sideplates.
Figure 18:
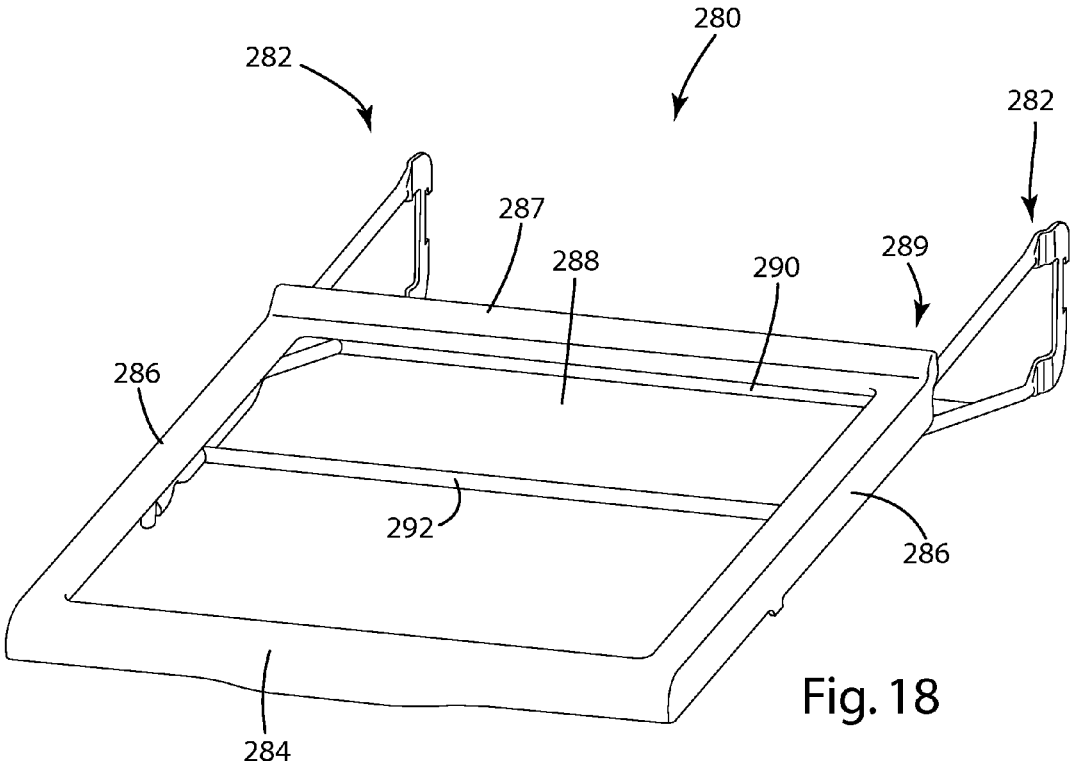
FIG. 18 is a perspective view of a glass shelf assembly interconnected to a side plate assembly, with the configuration providing for the glass shelf assembly to be slidably engaged with the sideplate assembly, and with the shelf assembly in an extended position relative to the sideplate assembly.
Figure 19:
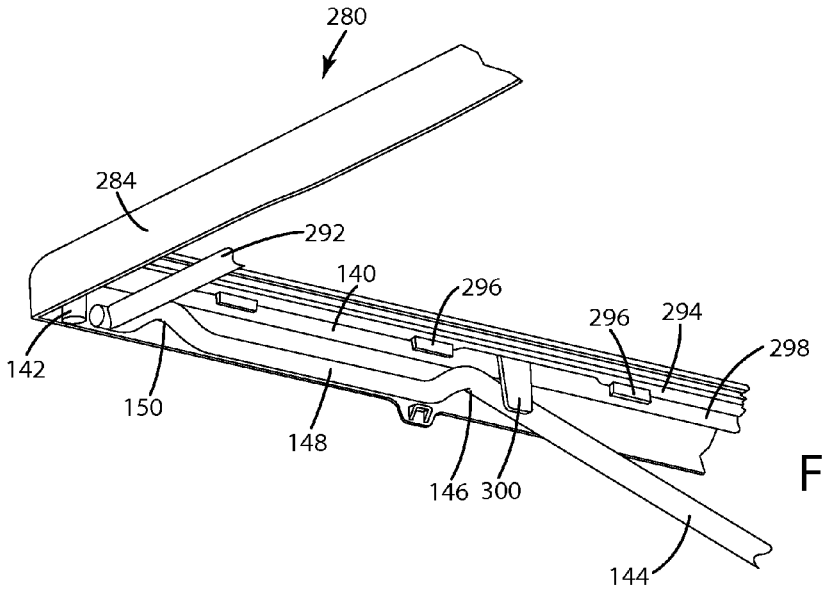
FIG. 19 is an enlarged view of a corner interconnection of the glass shelf assembly and the sideplate assembly shown in FIG. 18, and with the shelf assembly being in a retracted position relative to the sideplate assembly.
Figure 20:
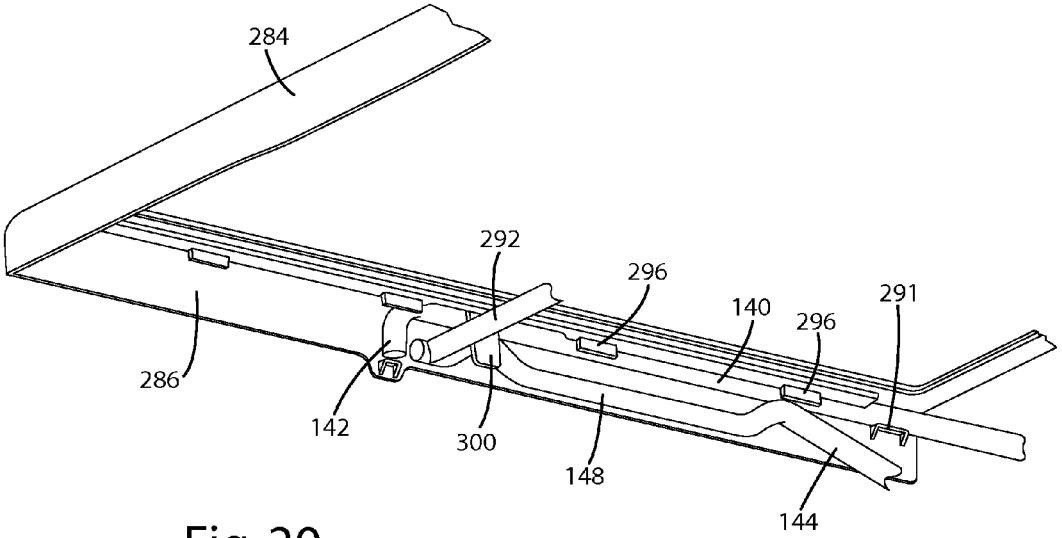
FIG. 20 is an underside perspective view of the slidable engagement between the shelf assembly and the sideplate assembly of FIG. 18, and with the shelf assembly being in an extended position relative to the sideplate assembly.

As previously described herein, the wire sideplates may be utilized with numerous types of shelving assemblies. For example, sideplates may be utilized with a sliding shelf assembly 280 illustrated in FIGS. 17-20. FIG. 17 is an exploded view, showing the individual components of the shelf assembly 280. FIG. 18 illustrates the sliding shelf assembly 280, with the shelf partially slid outwardly from its retracted position. FIG. 19 is an underside view showing one corner of the shelf assembly 280, with the shelf assembly in a fully retracted position. FIG. 20 illustrates an underside view of one side of the shelf assembly 280, with the shelf assembly in a partially extended position.

With reference to these drawings, the sliding shelf assembly 280 is adapted for use with a pair of wire sideplates 282. The wire sideplates 282 correspond in structure and function to the wire sideplates 102 previously described herein. Accordingly, components of the wire sideplates 282 are shown with numerical references in FIGS. 17-20, with the numerical references corresponding to the references for identical components of the wire sideplates 102 previously described herein.

The assembly 280 includes a front portion 284, a pair of opposing side portions 286 and a rear portion 287. The front 284, sides 286 and rear 287 form a shelf frame 289. The shelf frame 289 secures a glass shelf 288.

With respect to the wire sideplates 282, they are positioned one on each side of the shelf assembly 280 and are interconnected by a rear transverse support rod 290 and a forward transverse support rod 292. As shown in FIGS. 19 and 20, with respect to one of the wire sideplates 282, the forward extension 140 of the wire sideplate 282 rides within a channel 298 formed within the shelf frame 289 of the shelf assembly 280. Also shown in FIGS. 17, 19 and 20 are channel guides 296. The channel guides 296 correspond in function to the previously described channel guides 182 associated with the shelf assembly 170. Also shown in FIGS. 17, 19 and 20 is a stop stub 300 which projects downwardly from the side 286 of the shelf frame 289. It is apparent that although FIGS. 19 and 20 only show one side 286 of the shelf frame 289, and one of the pair of wire sideplates 282, a corresponding structure will exist with respect to the other sideplate 282 and the other side 286 of the shelf frame 289. This is apparent from the exploded view of FIG. 17.

With the configuration as shown in FIGS. 17-20, the shelf assembly 280, comprising the shelf frame 289 and glass shelf 288, is free to move between a retracted position (as shown in FIG. 19) and an extended position. FIGS. 18 and 20 illustrate the shelf assembly 280 as being almost in a fully extended position. The extension of the shelf assembly 280 relative to the wire sideplates 282 is limited by the stop stubs 300. More specifically, as the shelf assembly 280 is extended on the wire sideplates 282, the front transverse support rod 292 will abut the stop stubs 300, thereby preventing further relative extension of the shelf assembly 280. Further, to prevent the shelf frame 289 from "tipping" forward, if weight is placed on the forward portion of the shelf 288, each side 286 of frame 289 includes a rear ledge 291. One of the rear ledges 291 is shown in FIG. 20. If the frame 289 starts to tip forward, the forward extension 140 will abut the corresponding ledge 291, thereby preventing any additional tilting movement.

The particular shelf assemblies previously described herein for use with wire sideplates have primarily comprised assemblies which are typically constructed with plastic frames and glass shelf surfaces. It should be emphasized that the wire sideplates are not, in any manner, limited to use with such shelf assemblies. The wire sideplates can be utilized with various other types of shelf assemblies. For example, wire sideplates can be utilized with a wire shelf assembly, such as the wire shelf assembly 302 illustrated in FIG. 21.

Figure 21:
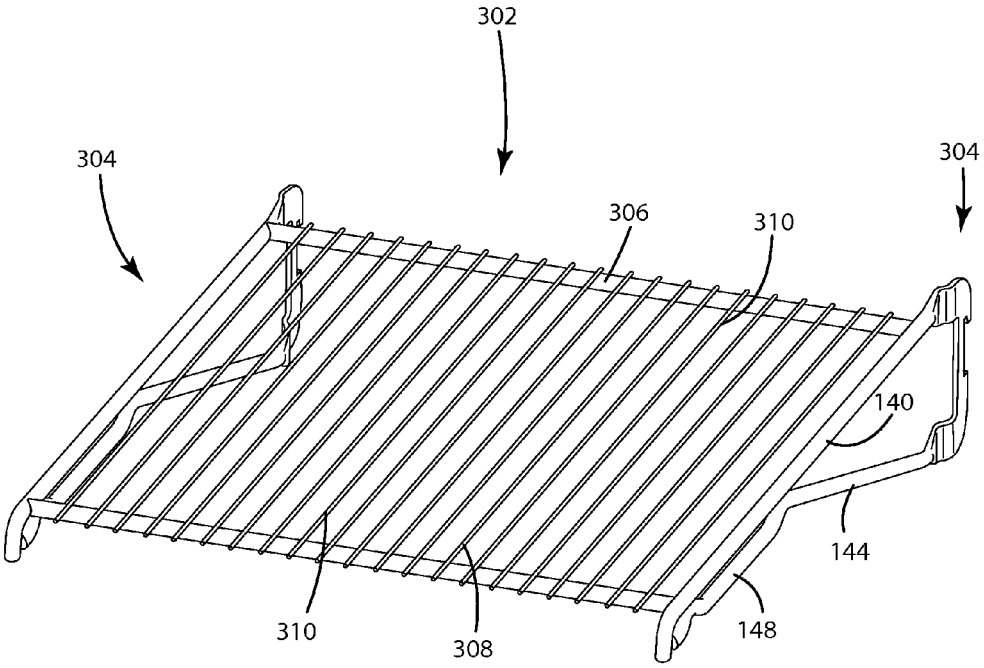
FIG. 21 illustrates a pair of sideplates in use with a wire shelf assembly.

Referring specifically to FIG. 21, the wire shelf assembly 302 is formed with a pair of opposing wire sideplates 304. The wire sideplates 304 correspond to the wire sideplates 102 previously described herein. The shelf assembly 302 also includes a rear transverse support rod 306 and front transverse support rod 308. Both of the support rods 306, 308 may be welded or otherwise fixedly secured to both of the wire sideplates 304. The transverse support rods 306, 308 are welded or otherwise secured to the upper, forward extension 140 of each of the wire sideplates 304. To form the surface portion of the shelf assembly 302, a series of wire shelf supports or rods 310 may be longitudinally positioned and have their opposing ends welded or otherwise fixedly secured to both the rear transverse support rod 306 and front transverse support rod 308. The wire shelf supports 310 may be formed, as shown in FIG. 21, so as to be parallel to each other. The shelf supports 310 may also be varied in number, depending upon the density of the shelf supports 310 desired for purposes of forming a shelf surface. In addition to the use of the sideplates 304 with the rods 310, the sideplates 304 may be used with other steel shelving, such as with sheet steel shelving. Still further, may be used with numerous other types of shelf assemblies, in addition to those specifically described herein.

To facilitate securing of the wire sideplates to the shelf assemblies through encapsulation of the wire sideplates by means of injection molding processes, a further embodiment of a wire sideplate has been developed. This embodiment is described herein as wire sideplate 350 and is illustrated in FIGS. 22-28. Although the wire sideplate 350 is not shown in association with a companion wire sideplate frame or any particular shelf assembly, it is apparent that wire sideplate 350 can be utilized with cantilever ladders and other supporting elements for supporting shelf assemblies as previously described herein for the other embodiments of wire sideplates.

The wire sideplate 350, like the other wire sideplates described herein, comprises a single piece of wire which is formed and then pressed or stamped so as to releasably interconnect with a number of different types of cantilever ladders uses for shelving systems in various embodiments. As with the other wire sideplates previously described herein, the wire sideplate 350 employs relatively less steel than known shelving systems, which typically utilize solid pieces of stamped metal as support brackets or sideplates for shelving assemblies. Further, require relatively less finishing material, in view of the relative reduction in surface area. Also, sideplate 350 is of relatively lighter weight than prior art sideplates. In addition, wire sideplate 350 allows for substantially more light transmission and airflow than known sideplate configurations.

Figure 22:
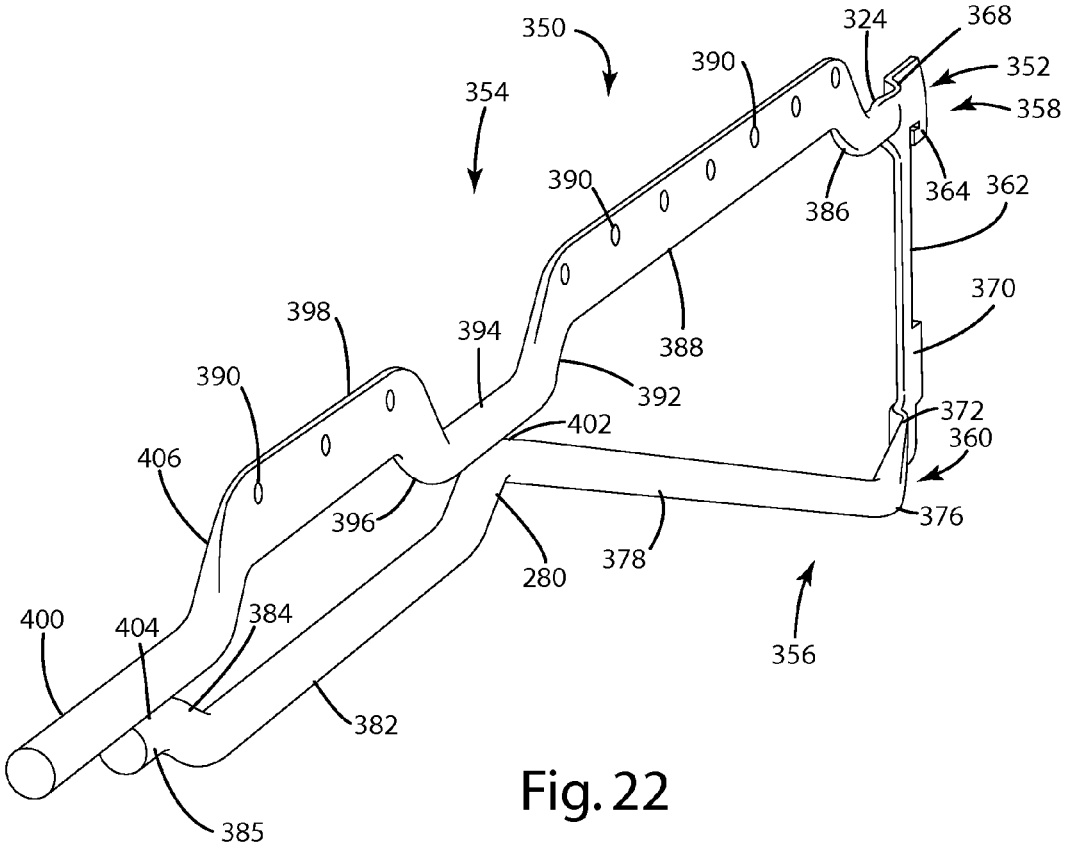
FIG. 22 is a perspective view of an alternative embodiment of a wire sideplate.
Figure 23:
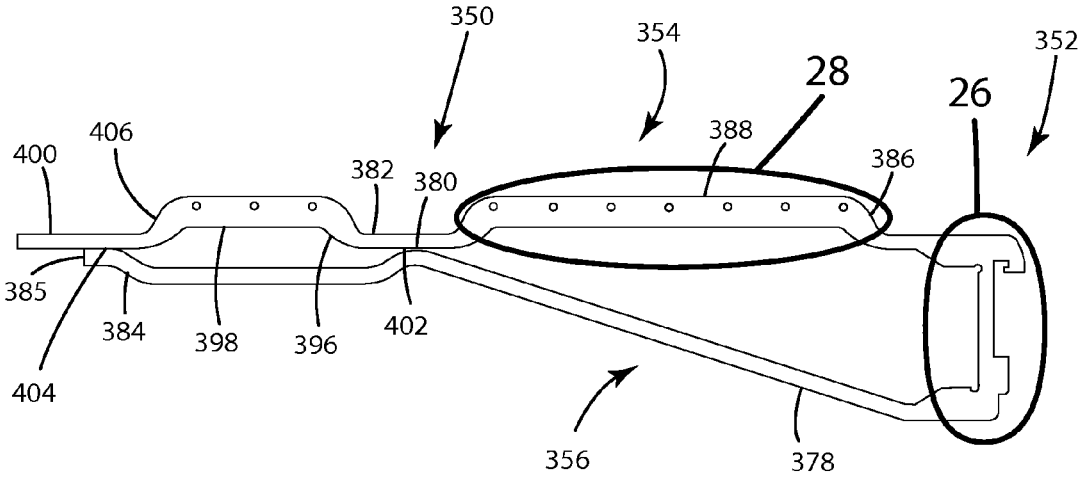
FIG. 23 is a side elevation view of the sideplate illustrated in FIG. 22.
Figure 24:
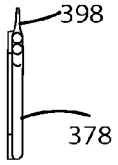
FIG. 24 is a front elevation view of the wire sideplate illustrated in FIG. 23.
Figure 25:
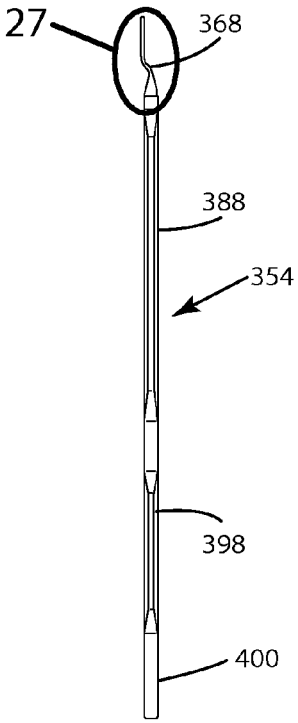
FIG. 25 is a top, plan view of the wire sideplate illustrated in FIG. 23.
Figure 26:
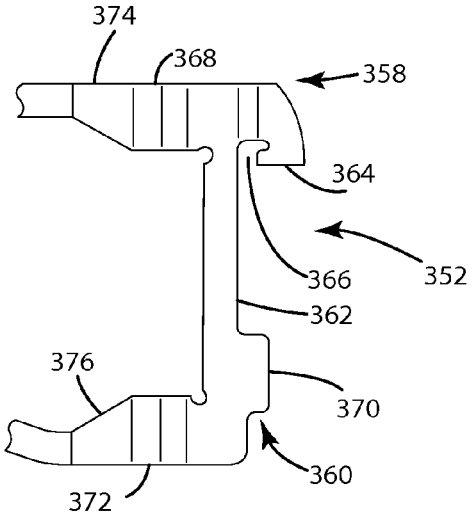
FIG. 26 is an enlarged view of the connector portion of the sideplate identified in FIG. 23 by the circle 26, illustrating detail of the ladder connector of the wire sideplate.
Figure 27:
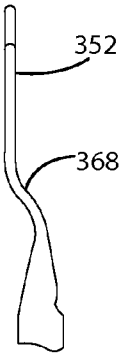
FIG. 27 is an enlarged view of the top plan view of the ladder connector of the wire sideplate identified in FIG. 25 by the circle 27, illustrating greater detail of the angled offset of the ladder connector of the wire sideplate.
Figure 28:
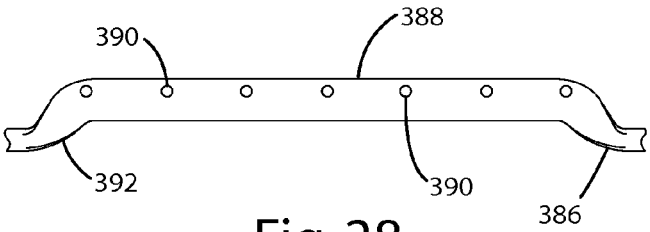
FIG. 28 is an enlarged view of a stamped and perforated section of the wire sideplate, identified in FIG. 23 by the circle 28.

Turning to the drawings, the wire sideplate 350 is shown in perspective view in FIG. 22. For purposes of supporting a shelf assembly (not shown in FIG. 22), the wire sideplate 350 would be utilized with a companion wire sideplate 350, in a manner similar to the prior description of wire sideplate frame 100. Details of the wire sideplate 350 are particularly shown in FIGS. 23-28. With reference first to FIGS. 23 and 26, the wire sideplate 350 includes a rearwardly projecting ladder connector 352. This ladder connector 352 is similar in structure to the previously described ladder connector 114 utilized with the wire sideplates 102. The ladder connector 352 has a flattened configuration and, similar to previously-described ladder connector 114, is adapted to releasably interconnect with conventional cantilever ladders traditionally used for shelf supports and the like. Extending forward from the rearwardly positioned ladder connector 352 is an upper sideplate arm 354, shown in particular in FIG. 23 and partially shown in FIG. 28. In addition to the upper sideplate arm 354, a lower sideplate arm 356 also extends forwardly from the ladder connector 114. Details of the sideplate arms 354, 356 will be described in subsequent paragraphs herein.

Returning to the ladder connector 352, the connector 352 is shown in enlarged detail in FIG. 26. With reference thereto, the ladder connector includes an upper connector bracket 358 and a corresponding lower connector bracket 360. As shown primarily in FIGS. 25 and 27, the ladder connector 352 may have an offset configuration relative to a plane formed by the elongated sideplate arms 354, 356. This offset configuration facilitates the releasable interconnection with cantilever ladders.

In addition to the upper connector 358 and lower connector bracket 360, the ladder connector 352 also includes an intermediate flange 362, having an elongated configuration and a vertically disposed orientation when the sideplate 350 is in use. Returning to the upper connector bracket 358, the rear portion of the upper connector bracket 358 terminates in a downwardly projecting tongue 364. The tongue 364 is shaped and sized so as to form an undercut slot 366 between the tongue 364 and the upper portion of the intermediate flange 362. When releasably connected to a cantilever ladder, the tongue 364 is designed so as to fit within a conventional slot of a known cantilever ladder. Further, the tongue 364 and the slot 366 are sized so that when the tongue 364 is fitted within a slot of a cantilever ladder, the tongue 364 (and the entirety of the sideplate 350) can be moved downwardly so as to releasably engage the sideplate 350 with the cantilever ladder. With known cantilever ladders, this type of configuration prevents the sideplate 350 from being inadvertently released from the cantilever ladder. Instead, forces must be directed upwardly on the sideplate 350 so as to disengage the tongue 364 from the cantilever ladder.

Further, the lower connector bracket 360 includes a tab 370 at the upper portion thereof. The tab 370 also has a vertical orientation and, like the tongue 364, is adapted to fit within a slot of a conventional cantilever ladder. It is the interconnections of the tongue 364 and tab 370 within the slots of the cantilever ladder which provide for releasable interconnection and support of the wire sideplate 350 on the cantilever ladder. As apparent from the configuration of the ladder 352, when the wire sideplate 350 supports weight on its extended support arms 354, 356, such weight will exert cantilever forces on the cantilever ladder through the connections of the tongue 364 and tab 370.

Turning again to FIGS. 23-28, extending forwardly from the lower connector bracket 360 is a lower angled portion 372 having an angled configuration as primarily shown in FIGS. 25 and 27. The lower angled portion 372 extends from the lower connector bracket 360 to a lower reverse taper section 376. The lower reverse taper section 376 is integral with an upwardly angled extension or a section 378 of the lower sideplate arm 356. As shown in substantial part in FIGS. 22 and 23, the upwardly angled extension 378 extends upwardly and is integral in its termination with a first curved section 380. The first curved section 380 is integral with an upwardly angled extension 378 and a horizontal extension 382. At the forward portion of the horizontal extension 382 is an integral second curved section 384. The second curved section 384 terminates at a distal end section 385. The distal end section 385 terminates in a position immediately below and slightly behind a terminating end of the upper sideplate arm 354.

Returning to the upper portions of the wire sideplate 350, the upper sideplate arm 354 and associated sections of the wire sideplate 350 will now be described. It is the upper sideplate arm 354 of the wire sideplate 350 which consists of the features which most distinguish the wire sideplate 350 from the previously described wire sideplates 102. More specifically, extending forwardly from the upper connector bracket 358 is an upper angled section 368. This angle or offset is primarily shown in FIGS. 25 and 27. The upper angled portion 368 extends from the upper connector bracket 358 to an upper reverse taper section 374. The upper reverse taper section 374 is integral with the upper sideplate arm 354. It is worthwhile at this point to emphasize that although the wire sideplate 350 invention is being described with respect to "individual" portions or elements, the wire sideplate 350 is actually formed from a single wire composed of steel or other appropriate components. The relationship between the upper angled portion 368, upper reverse taper section 374 and upper sideplate arm 354 is one where all elements are integral with adjacent elements. That is, these and other elements of the wire sideplate 350 are formed (and remain) as a single steel (or other material) component.

Returning to the upper portions of the wire sideplate 350, a forward end of the upper reverse taper section 374 is integral with the proximal end of the upper sideplate arm 354. More specifically, the upper reverse taper section 374 is integral with an upwardly angled section 386, primarily shown in FIGS. 22, 23 and 28. The upwardly angled section 386 terminates and is integral with a first encapsulate section 388, having the configuration primarily shown in FIGS. 22, 23 and 28. As will be described in greater detail herein, this section 388 is referred to as an "encapsulate" section, in view of the fact that it will be encapsulated through injection molding processes with the shelf assembly to which it is to be attached. As shown in the drawings, the first encapsulate section 388 has a relatively "flattened" configuration which is achieved through stamping processes. A series of perforations 390 is formed along the upper portion of the encapsulate section 388. During the injection molding process, the perforations 390 facilitate the flow of the thermoplastic material around the encapsulate section 388.

At the terminating end of the first encapsulate section 388 is an integral downwardly angled section 392. The downwardly angled section 392 is integral with a substantially horizontal intermediate section 382. The terminating end of the intermediate section 394 is integral with a further upwardly angled section 396. The upwardly angled section 396 terminates in a second encapsulate section 398. In the particular embodiment of the wire sideplate 350 shown herein, the second encapsulate section 398 is configured in substantially the same manner as the first encapsulate section 388, but is of a relatively shorter length. The particular sizes of the encapsulate section 388 and 390 essentially comprise design features. As with the first encapsulate section 388, the second encapsulate section 398 has a substantially flattened configuration, which again would be achieved through stamping processes. Also similar to the first encapsulate section 388, the second encapsulate section 398 may include perforations 390, for purposes of facilitating flow of thermoplastic resin around the second encapsulate section 398 during injection molding processes.

The second encapsulate section 398 terminates in a downwardly angled section 406. Correspondingly, the downwardly angled section 406 terminates in a distal section 400 forming the distal end of the upper sideplate arm 354. If desired, and for purposes of potentially providing additional rigidity to the wire sideplate 350, the upper sideplate arm 354 can be welded or otherwise secured to the lower sideplate arm 356 at various locations. For example, the first curved section 380 of the lower sideplate arm 356 could be welded or otherwise secured to the upper sideplate arm 354 at weld point 402, shown in FIGS. 22 and 23. Correspondingly, the second curved section 384 of the lower sideplate arm 356 could be welded or otherwise secured to the upper sideplate arm 354 at weld point 404 also shown in FIGS. 22 and 23. Again, these weld connections (or other connection means) can be utilized to provide additional rigidity to the wire sideplate 350.

In addition to these previously described wire sideplates 102 and 350, other wire sideplates may employ other means for supporting shelf assemblies. Such further embodiments of wire sideplates are described herein and illustrated in FIGS. 29-36 as wire sideplates 430 and 432 utilized with wire sideplate assemblies 426 and 428, respectively. As will be described in greater detail herein, each of the wire sideplate assemblies 426, 428 utilize wire sideplates similar to those previously described herein, with the sideplate assemblies incorporating a flange for connection of the wire sideplate assemblies to components of shelf assemblies to be supported.

Figure 29:
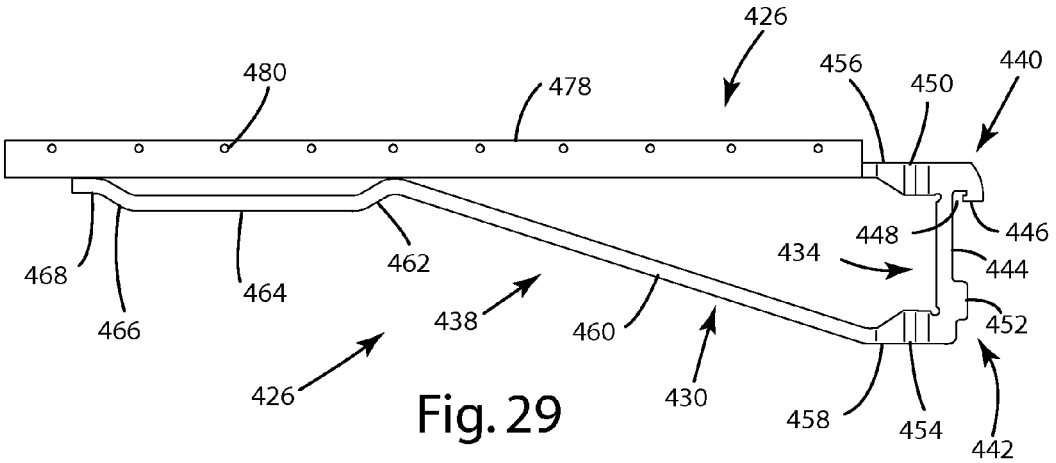
FIG. 29 is a side elevation view of a further embodiment of a wire sideplate which can be utilized with a wire sideplate frame, with the wire sideplate shown in FIG. 29 being characterized as a "right side" sideplate.
Figure 31:
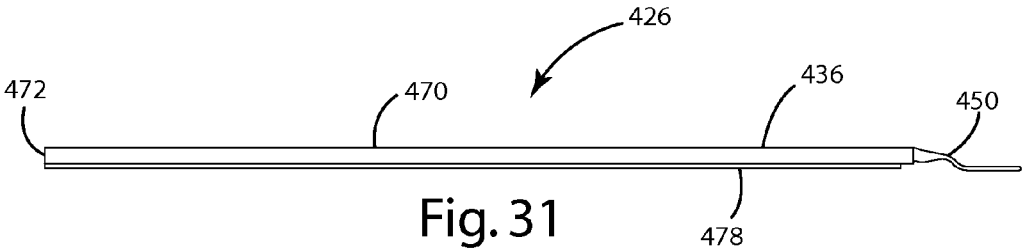
FIG. 31 is a top plan view of the wire sideplate illustrated in FIG. 29.
Figure 30:
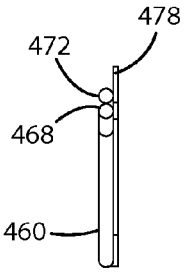
FIG. 30 is an end elevation view of the wire sideplate illustrated in FIG. 29.

The wire sideplate assembly 426 illustrated in FIGS. 29, 30 and 31 utilizes a wire sideplate 430 which is described in subsequent paragraphs herein. Correspondingly, wire sideplate assembly 428 illustrated in FIGS. 32, 33 and 34 utilizes a wire sideplate 432. The wire sideplate 432 is substantially identical to the wire sideplate 430, with relatively minor distinctions described subsequently herein. Still further, the wire sideplate 430 includes components configured substantially identical to certain components of the previously described wire sideplate 102 and the previously described wire sideplate 350. Turning first to wire sideplate 430 and FIGS. 29, 30 and 31, the wire sideplate 430 includes a rearwardly projecting ladder connector 434. The ladder connector 434 is substantially identical to the ladder connector 352 previously described with respect to wire sideplate 350. More specifically, the ladder connector 434 has a flattened configuration and is adapted to releasably interconnect with conventional cantilever ladders traditionally used for shelf supports and the like. Extending forward from the rear ladder connector 434 is an upper sideplate arm 436. The upper sideplate arm 436 is substantially identical to the upper sideplate arm 116 previously described with respect to wire sideplate 102. In addition to the upper sideplate arm 436, the wire sideplate 430 also includes a lower sideplate arm 438 extending forward from the ladder connector 434. The lower sideplate arm 438 is substantially identical to both the lower sideplate arm 118 previously described with respect to wire sideplate 102, and the lower sideplate arm 356 previously described with respect to wire sideplate 350.

The ladder connector 434 includes an upper connector bracket 440 and a lower connector bracket 442. As shown primarily in FIG. 31, the ladder connector 434 may have an offset configuration relative to a plane formed by the elongated sideplate arms 436, 438. This offset configuration may be utilized to facilitate the releasable interconnection with cantilever ladders.

In addition to the upper connector bracket 440 and lower connector bracket 442, the ladder connector 434 also includes an intermediate flange 444, having an elongated configuration and a vertically disposed orientation when the sideplate 430 is in use. As shown in FIG. 29, the rear portion of the upper connector bracket 440 terminates in a downwardly projecting tongue 446. The tongue 446 is shaped and sized so as to form an undercut slot 448 between the tongue 446 and the upper portion of the intermediate flange 444. The tongue 446 and undercut slot 448 are substantially identical to the tongue 364 and undercut slot 366 previously described herein with respect to wire sideplate 350. The configuration of the tongue 446 and undercut slot 448 prevents the sideplate 430 from being inadvertently released from a cantilever ladder. Instead, forces must be directed upwardly on the sideplate 430 so as to disengage the tongue 446 from a cantilever ladder to which it is secured.

The lower connector bracket 442 includes a tab 452 at the top portion thereof. The tab 452 has a vertical orientation and, like the tongue 446, is adapted to fit within a slot of a conventional cantilever ladder. It is the interconnections of the tongue 446 and the tab 452 which provides for releasable interconnection and support of the wire sideplate 430 on a cantilever ladder. Again, the ladder connector 434 and the functional operation thereof is substantially identical to the structure and function of the ladder connector 352 associated with the wire sideplate 350.

Extending forwardly from the upper connector bracket 440 is an upper angled portion 450 as shown in FIGS. 29 and 31. The upper angled portion 450 extends from the upper connector bracket 440 to an upper reverse taper section 456. The upper reverse taper section 456 is integral with the upper sideplate arm 436. As with the previously described wire sideplates 102 and 350, the wire sideplate 430, although being described with respect to individual elements, is formed from a single wire composed of steel or other appropriate components. Accordingly, the ladder connector 434 is actually formed and stamped so as to have a flattened configuration. However, the relationship between the upper angled portion 450, upper reverse taper section 456 and arm 436 is one where all elements are integral with adjacent elements.

Extending forward from the lower connector bracket 442 is a lowered angled portion 454 having an angled configuration substantially identical to the angled configuration of the upper angled portion 450. The lower angled portion 454 extends from the lower connector bracket 442 to a lower reverse taper section 458. The lower reverse taper section 458 is integral with an upwardly angled extension 460 of the lower sideplate arm 438. The lower sideplate arm 438 is substantially identical to the lower sideplate arms 118 of wire sideplate 102 and 356 of wire sideplate 350. Accordingly, the upwardly angled extension section 460 extends upwardly and is integral at its termination with a first curved section 462. The first curved section 462 is integral with a horizontal section 464. At the distal end of the horizontal section 464 is an integral second curved section 466. The second curved section 456 is integral with a distal end section 468. The distal end section 468 terminates a position immediately below and slightly behind a terminating end of the upper sideplate arm 436.

Returning to the upper portions of the wire sideplate 430, the upper angled section 450 is integral with and extends between the upper connector bracket 440 and the upper reverse taper 456. At the forward end of the upper reverse taper section 456, a proximal and of a horizontal section 470 is integrally formed. The horizontal section 470 extends forwardly, terminating in a distal end 472 as shown in FIG. 31.

As earlier stated, the wire sideplate assembly 426 differs from the previously described wire sideplates 102 and 350, in that the wire sideplate assembly 426 includes a connection flange 478, illustrated in FIGS. 29, 30 and 31 as attached to the wire sideplate 430. The flange 478 is also shown in a stand alone configuration in FIGS. 35 and 36. The connection flange 478 has a substantially elongated and rectangular configuration, and is adapted to be secured in any suitable manner to the wire sideplate 430. In the particular embodiment shown in FIGS. 29, 30 and 31, the connection flange 478 can be secured by welds between the horizontal extension 464 of the wire sideplate 430 and the connection flange 478. Such welds could be in the form of a weld 482 extending entirely along the length of the connection flange 478 and the horizontal section 464. Alternatively, weld points 484 could be utilized at spaced apart locations between the connection flange 478 and the horizontal section 464. Still further, other types of connection means may be utilized. Still further, the connection flange 478 may be secured to other elements of the wire sideplate 430. As further shown in FIG. 29, the flange 478 may include a series of through holes 480 extending laterally through the sides of the connection flange 478. The through holes may be utilized as perforations to assist in encapsulation of the flange 478 during injection molding procedures. In this manner, the flange 478 is secured to a shelf assembly. Also, it should be apparent that other types of connection means may be utilized to secure the flange 478 to a shelf assembly.

With the use of flange 478 and the structural configurations shown in FIGS. 29, 30 and 31 wherein the connection flange 478 is secured to one side of the horizontal section 470, it would be preferable for the connection flange 478 to be "inside" the wire sideplate 430 when the wire sideplate 430 is connection to a shelf assembly. In this regard, the wire sideplate assembly 426 shown in FIGS. 29, 30 and 31 could be characterized as a "right side" wire sideplate assembly. That is, with the assumption that a person is looking from the rear of the wire sideplate assembly 426 toward the forward portion thereof, the wire sideplate assembly 426 should be positioned to the right of the shelf assembly being supported and to which the connection flange 478 is secured.

Figure 32:
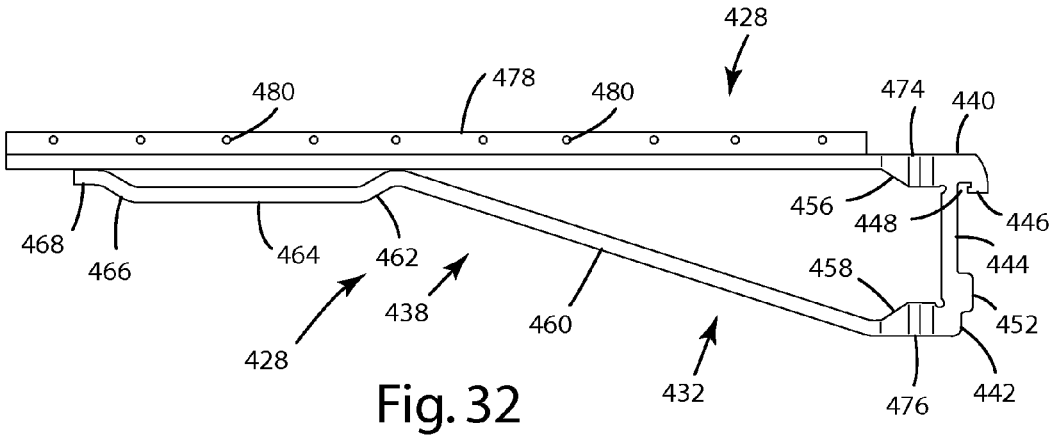
FIG. 32 is a side elevation view of an alternative embodiment of a wire sideplate comprising a companion sideplate which is used in conjunction with the wire sideplate illustrated in FIG. 29, the wire sideplate in FIG. 32 being characterized as a "left side" wire sideplate.
Figure 34:
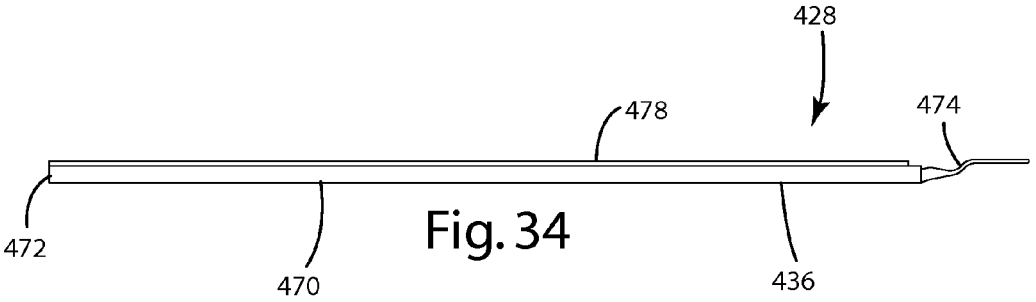
FIG. 34 is a top plan view of the wire sideplate illustrated in FIG. 32.
Figure 33:
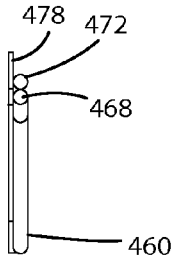
FIG. 33 is an end elevation view of the wire sideplate illustrated in FIG. 32.
Figure 35:
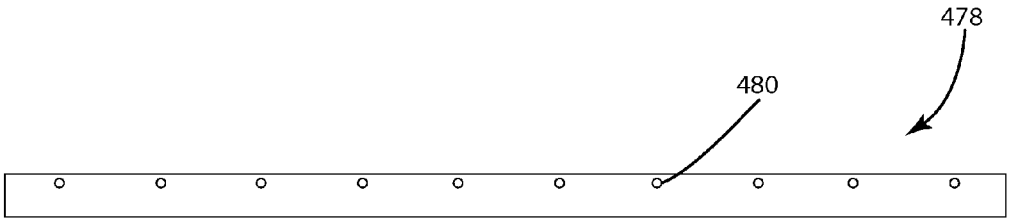
FIG. 35 is a side elevation and stand-alone view of a flange, with the flange being illustrated in FIGS. 29-34 as being used with the wire sideplates also shown in FIGS. 29-34.
Figure 36:
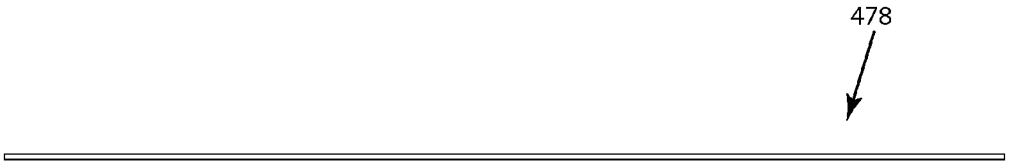
FIG. 36 is a top plan view of the flange illustrated in FIG. 35.

The wire sideplate assembly 428 is illustrated in FIGS. 32, 33 and 34, and utilizes wire sideplate 432. The wire sideplate assembly 428 is substantially similar to the wire sideplate assembly 426. However, with the previous reference to the wire sideplate assembly 426 as being a "right side" sideplate assembly, the wire sideplate assembly 428 can be characterized as a "left side" wire assembly. That is, keeping in mind that the flange 478 is preferably located "inside" of the wire sideplate 432, the wire sideplate 432 would be positioned on the left side of a shelf assembly to which is connected, if the viewer is positioned at the rear portion of the wire sideplate 428 and is looking toward the forward end of the wire sideplate 432. Because of the substantial similarities between the wire sideplate assembly 426 and the wire sideplate assembly 428, like elements of the assemblies 426, 428 are shown as being like numbered. With respect to the distinctions between the wire sideplate 430 and the wire sideplate 432, the only distinctions lie in the offset configurations which may be utilized with the wire sideplates 430, 432. As shown in FIGS. 29 and 31, the wire sideplate 430 includes upper and lower angled portions 450, 454, respectively, to offset the sideplate arms 436, 438 from the ladder connector 434. As shown in FIGS. 32 and 34, the wire sideplate 432 also has corresponding upper and lower angled portions 474, 476 respectively. However, as apparent from comparison of the illustrations, the offsets provided by angled portions 450, 454 for the wire sideplate 430 are in an opposite configuration relative to the offsets provided by the angled portions 474, 476 for wire sideplate 432. Also, as apparent from the prior discussion relating to the fact that the connection flange 478 is preferably on the "inside" of its corresponding wire sideplate, the connection flange 478 utilized with the wire sideplate 432 is secured to the wire sideplate 432 on the opposite side of its connection to wire sideplate 430. Again, however, it should be emphasized that the offset configurations of the wire sideplates are not an absolute requirement, and the flange 478 can be secured to various portions (and by various means) of the wire sideplates 430, 432.

Figure 37:
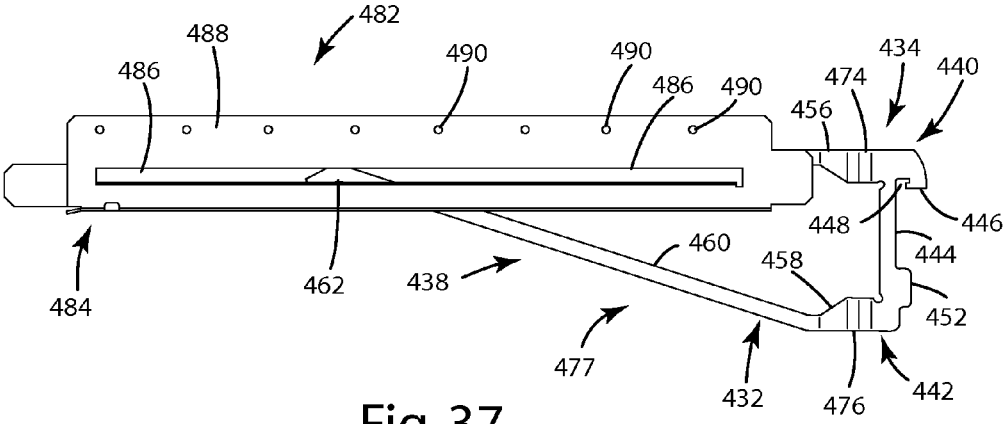
FIG. 37 is a side elevation view of a still further embodiment of a wire sideplate and flange.
Figure 38:
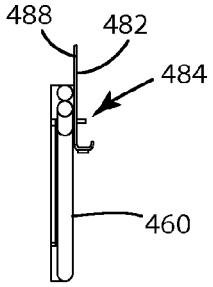
FIG. 38 is an end elevation view of the wire sideplate and flange shown in FIG. 37.
Figure 39:
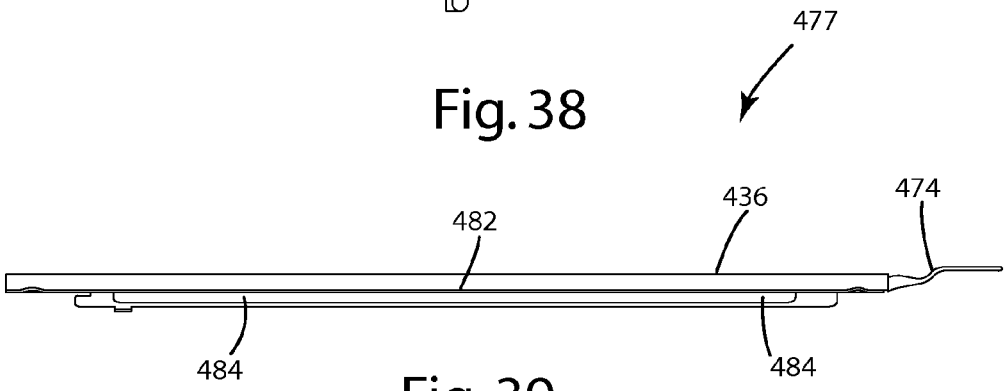
FIG. 39 is a top plan view of the wire sideplate and flange illustrated in FIG. 37.
Figure 40:
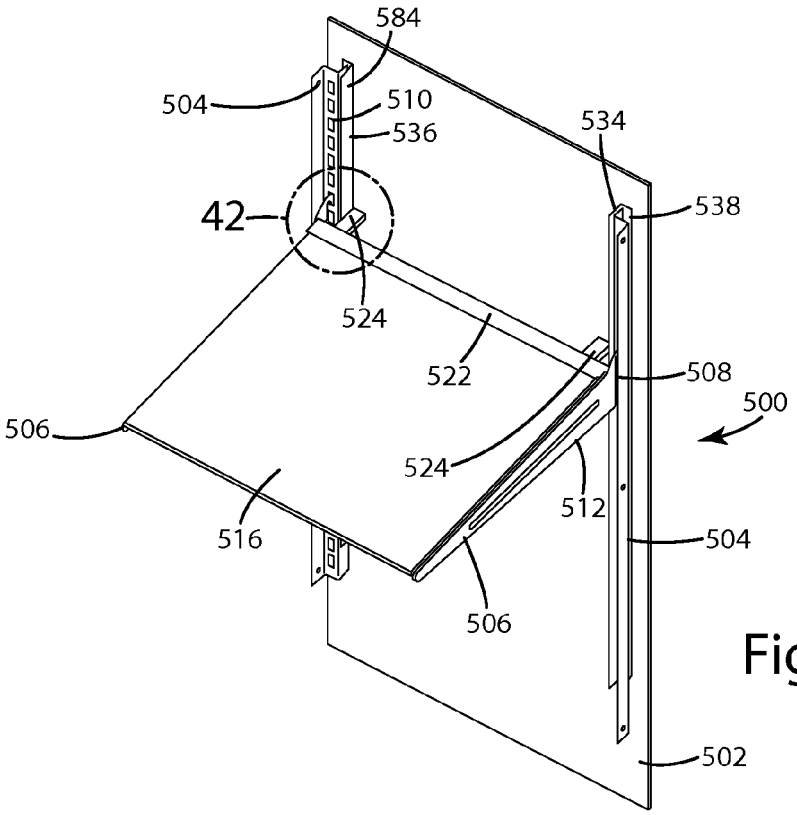
FIG. 40 is a perspective overview of a shelf assembly utilizing an LED assembly in accordance with the invention.

A still further wire sideplate assembly is described herein as wire sideplate assembly 477 and illustrated in FIGS. 37, 38 and 39. As will be described in subsequent paragraphs herein, the wire sideplate assembly 477 is advantageous in that it provides a means for conveniently coupling a shelf assembly (not shown in the drawings) to wire sideplates of the wire sideplate assembly 477 in a manner so as to permit slidable movement of the shelf assembly relative to the wire sideplate assembly 477. Still further, the wire sideplate assembly 477 also permits an additional shelf assembly or other type of shelving elements to be encapsulated with components of the wire sideplate assembly 477 through use of plastic injection molding or the like.

More specifically, the wire sideplate assembly 477 can utilize a wire sideplate corresponding to the wire sideplate 432 previously described with respect to the wire sideplate assembly 428 illustrated in FIGS. 32, 33 and 34. Accordingly, the wire sideplate utilized in the wire sideplate assembly 477 is identified as wire sideplate 432, and numerical references for elements of the wire sideplate 432 shown in FIGS. 37, 38 and 39 correspond to the numerical references shown in FIGS. 32, 33 and 34 for identical elements of the wire sideplate 432. That is, with reference to FIGS. 37, 38 and 39, the wire sideplate assembly 477 comprises a wire sideplate 432 having a ladder connector 434, upper support arm 436 and lower support arm 438. Also included within the wire sideplate 432 shown in these drawings is an upper connector bracket 440, lower connector bracket 442 and intermediate flange 444. The wire sideplate 432 also includes a tongue 446, undercut slot 448, upper angled portion 474 and lower angled portion 476. A tab 452 is included on the intermediate flange 444, and the ladder connector 434 also includes an upper reverse taper 456 and a lower reverse taper 458. The lower support arm 438 includes an upwardly angled section 460 and first curved section 462.

Unlike the wire sideplate assembly 428, the wire sideplate assembly 477 includes a horizontally positioned and elongated slide flange 482. The slide flange 482 includes, at the lower portion thereof, a C-channel 484, as shown in the drawings. The C-channel 484 is adapted to receive, in a slidable manner, a portion of a shelf frame or shelf of a shelf assembly. In addition, the slide flange 482 also includes an elongated aperture 486, as primarily shown in FIG. 37. The elongated aperture 486 extends laterally through the sides of the slide flange 482, and is adapted to receive rollers or similar devices for facilitating sliding movement (and for limiting sliding movement) of an associated shelf assembly.

Still further, the slide flange 482 can also include an upper flange 488 having a series of perforations 490 extending thereto. The slide flange 482 can be constructed with this upper flange 488, so that this upper flange 488 could be encapsulated with a shelf assembly through injection molding processes or other processes utilizing thermoplastic materials. The perforations 490 facilitate flow of the thermal plastic materials around the upper flange 488 during the injection molding process. In this manner, the upper flange 488 can serve the same functions as the flange 478 previously described herein and illustrated in FIGS. 35 and 36.

The principles of the invention will now be described with respect to various shelving assemblies as illustrated in FIGS. 40-65. In accordance with shelving assemblies in accordance with the invention, the shelving assemblies will provide improved lighting within storage spaces, as well as provide lower cost light sources. When used in refrigerators, the shelving assemblies provide a relatively higher energy efficiency. Also, the shelving assemblies in accordance with the invention facilitate assembly, and have a relatively less complicated design for the LED configurations.

Still further, with the particular configurations in accordance with the invention, relatively more usable shelf space is provided. Also, less material is consumed in manufacturing the shelving assemblies. Still further, the designs of the electrical contact modules used with shelving assemblies in accordance with the invention allow for width tolerances which assure appropriate abutment to low voltage power strips. Still further, tolerance variation is provided for the refrigerator liner and the assembly operations. Still further, and in accordance with certain concepts of the invention, existing cantilever track shelf support or cantilever ladder designs do not have to be modified to incorporate the shelving assembly in accordance with the invention. Still further, a superhydrophobic feature can be provided in terms of a coating of the shelf associated with a shelving assembly, so as to retain a greater amount of water than existing designs.

The first shelving assembly in accordance with the invention is illustrated in FIGS. 40-48, and is referred to as shelving assembly 500. With reference to these drawings, the shelving assembly 500 can be characterized as an assembly utilized within a refrigerator and supported along a rear portion of a refrigerator liner 502. For purposes of support, a pair of elongated and vertically disposed cantilever ladders 504 (well known in the industry) are utilized and are fixedly attached to the liner 502. The attachment can be by connecting means such as screws, adhesives or the like. The cantilever ladders 504 include conventional ladder notches 510.

Figure 43:
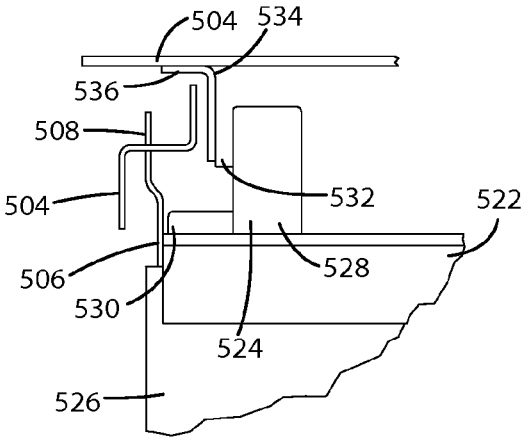
FIG. 43 is a sectional plan view of the portion of the shelf assembly shown in FIG. 42.
Figure 44:
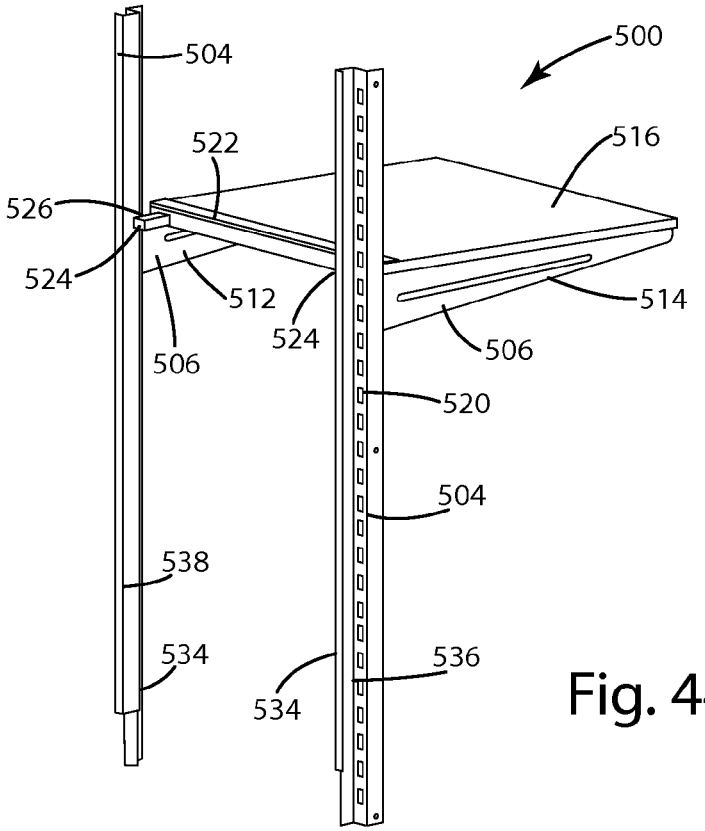
FIG. 44 is a rear perspective view of the shelf assembly shown in FIG. 40.
Figure 45:
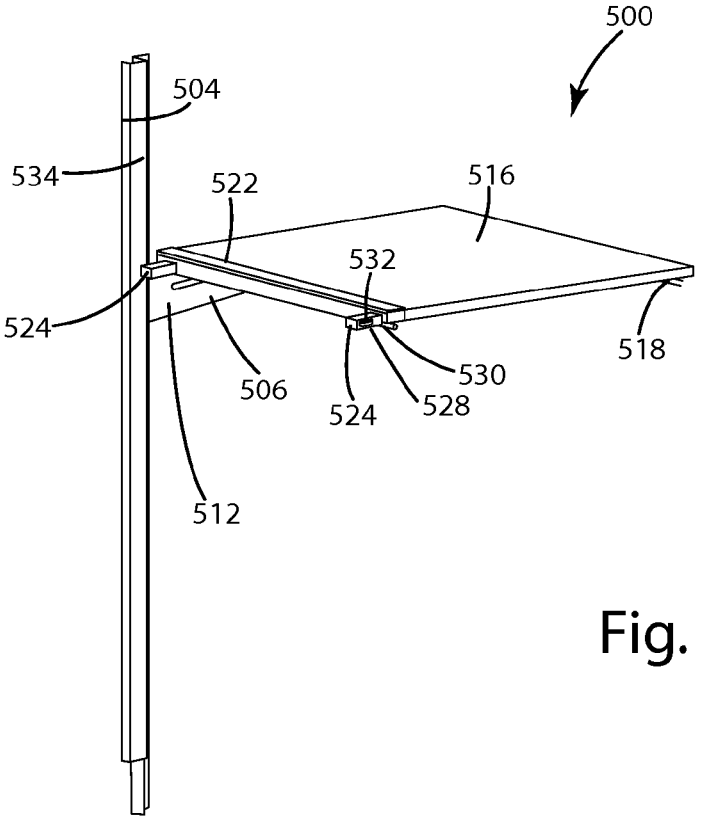
FIG. 45 is a view similar to FIG. 44, but showing the shelf assembly with the absence of one of the sideplates and cantilever ladders.

Associated with the shelving assembly 500 is a pair of sheet metal sidearms 506, shown as a right sidearm 512 and a left sidearm 514. The sidearms are utilized to releaseably secure the shelving assembly to the cantilever ladders 504. The sheet metal sidearms 506 include rearwardly projecting ladder connectors 508, one of which is shown in FIG. 43. Each ladder connector 508 is adapted to releaseably secure the corresponding sidearm 506 into a set of the ladder notches 510. It should be emphasized that references to "right" and "left" with respect to the sidearms 506 and other elements described herein have no significant design intent, other than being utilized for purposes of description and reference. The cantilever ladders 504, sidearms 506 and rearwardly projecting ladder connectors 508 can be characterized as a support means for supporting the refrigerator shelf 516 at a desired height.

Figure 41:
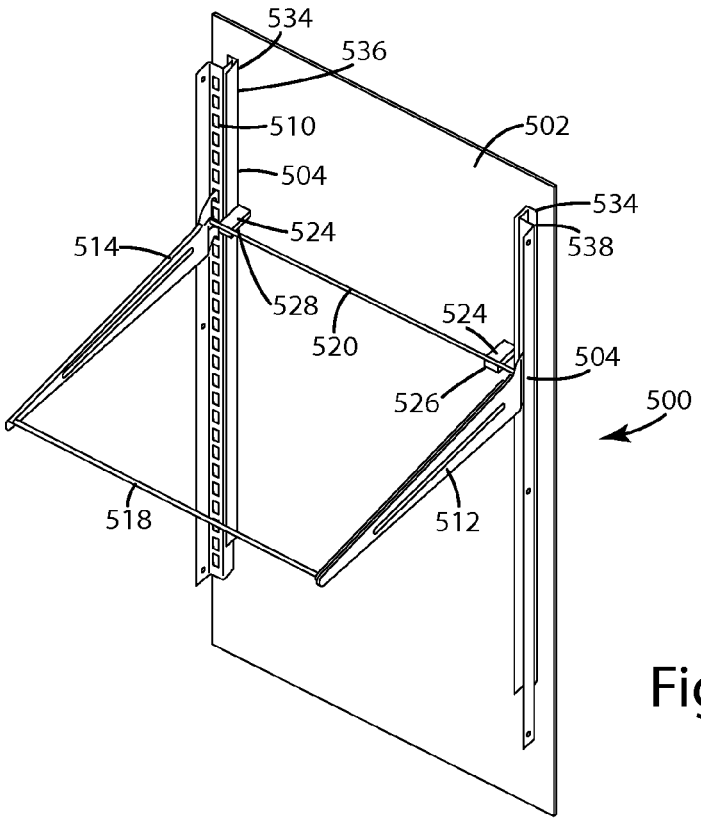
FIG. 41 is an underside view of the shelf assembly shown in FIG. 40.
Figure 42:
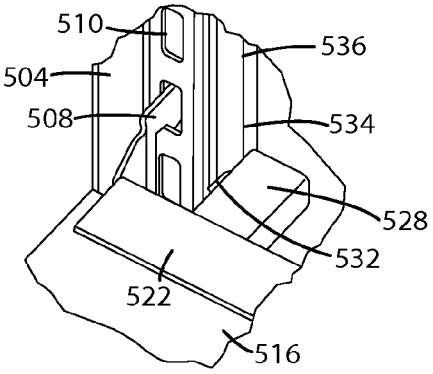
FIG. 42 is an enlarged view of the portion of the shelf assembly shown in FIG. 40 within the circle 42.

As shown specifically in FIG. 41, connected at the front portions of the sidearms 506 is a transverse and horizontally projecting forward support bar 518. This support bar 518 and the sidearms 506 are utilized to support a shelf 516. Preferably, the shelf 516 may be constructed of glass, plastic or other relatively clear material. As desired, adhesives or other similar materials can be utilized to bond the refrigerator shelf 516 to the sheet metal sidearms 506. The same bonding can be utilized with respect to other embodiments of shelving assemblies in accordance with the invention, described subsequently herein and utilizing wire sidearms. In addition, other means of connecting the shelf 516 to the sidearms 506 can be utilized, including various types of mechanical means. The means for securing the shelf 516 to the sidearms 506 can be characterized as a securing means, for securing the shelf to support means.

Figure 46:
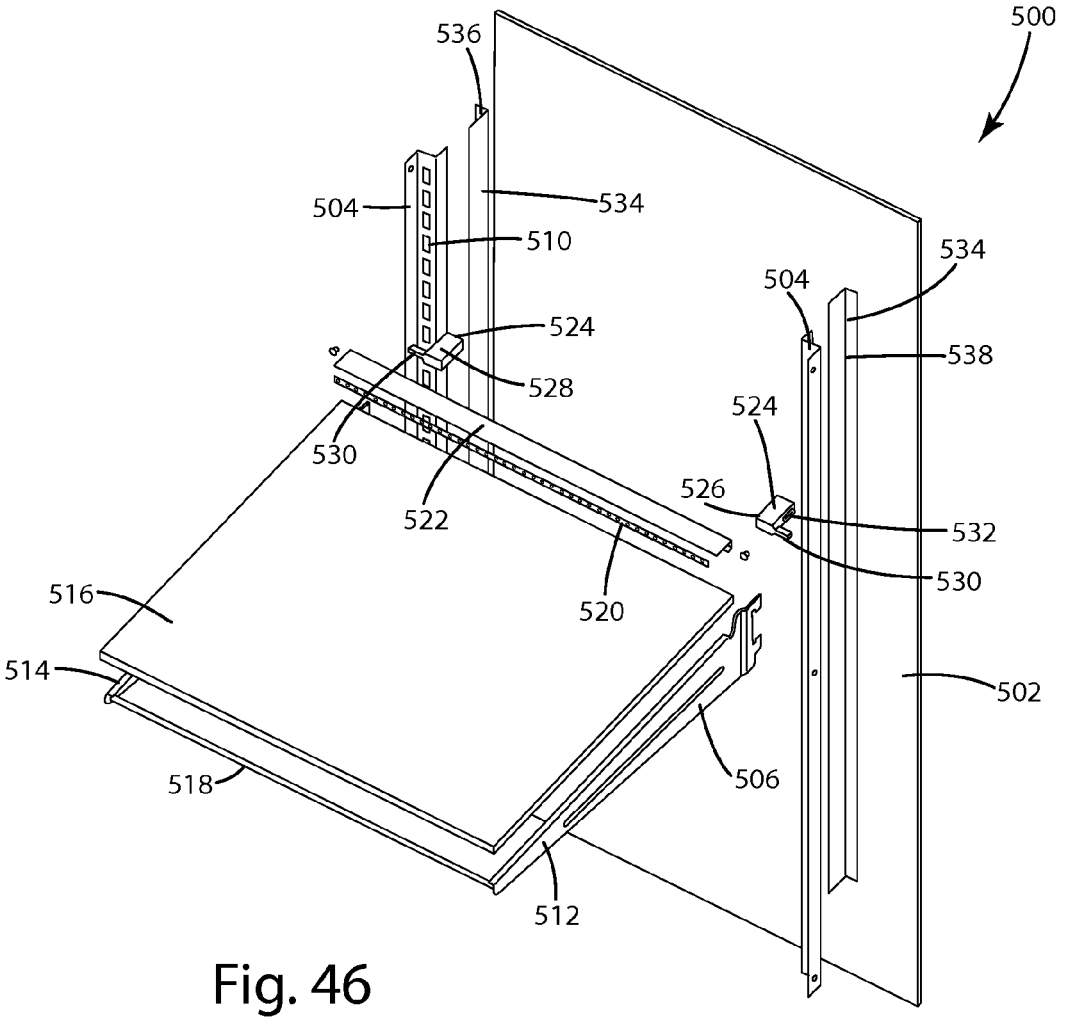
FIG. 46 is an exploded view of the shelf assembly shown in FIG. 40.
Figure 47:
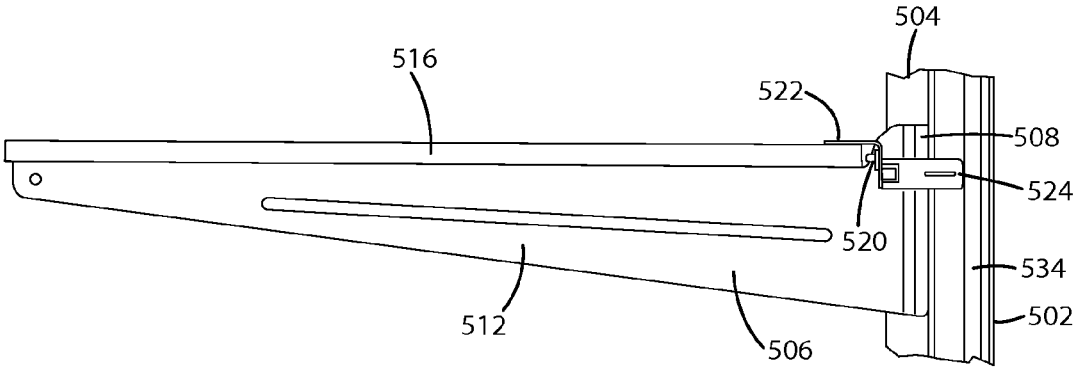
FIG. 47 is a partial side elevation view showing the relative positioning of the sheet metal sidearm and associated electrical contact module of the shelf assembly shown in FIG. 40.
Figure 48:
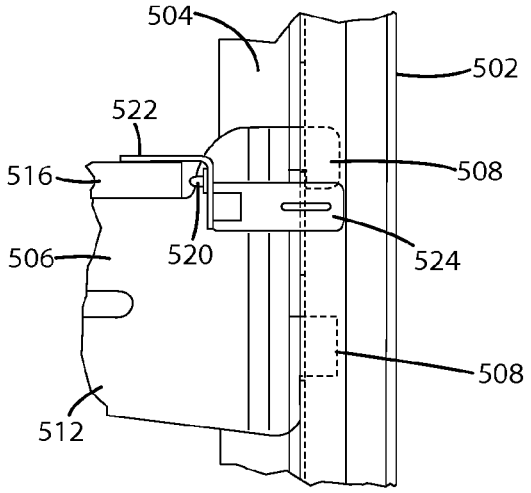
FIG. 48 is an enlarged and partially sectional view of a portion of the sidearm and electrical contact module shown in FIG. 47.

In accordance with a principal aspect of the invention, the shelving assembly 500 includes an LED strip 520, shown particularly in FIGS. 41 and 46. The LED strip 520 consists of a series spaced apart LEDs which provide for visible light upon application of relatively low voltages. The positioning of the LED strip 520, relative to the refrigerator shelf 516 is particularly shown in FIGS. 47 and 48. As illustrated therein, the LED strip 520 is located immediately behind the refrigerator shelf 516 and is centered with respect thereto.

The shelving assembly 500 utilizes a rear form 522 for purposes of securing the LED strip 520. The rear form 522 can be constructed from any of a number various metals, or can otherwise be composed of a plastic. It should be understood that future references herein to the rear form 522 being a "metal form" should be construed as being understood to include the possibility of use of materials for the form 522 other than metal. The rear form 522 is illustrated in a number of the drawings, including FIGS. 40 and 42-48. The rear form 522 is essentially an L-shaped form with the LED strip 520 extending longitudinally along one leg of the form 522. The form 522 can be welded or otherwise secured to the pair of sheet metal sidearms 506 previously described herein. The LED strip 520 can be secured to the form 522 by any suitable means, such as being fixedly attached to the form 522 through the use of adhesives, snap fitting configurations or the like.

The electrical portion of the shelving assembly 500 further includes a pair of electrical contact modules 524, identified in the drawings as the right electrical contact module 526 and the left electrical contact module 528. The modules 524 are shown in a number of the drawings, and are particularly shown in FIGS. 43 and 46. The electrical contact modules 524 include module connectors 530. The module connectors 530 and the electrical contact modules 524 can be fixedly attached to the form 522 through any suitable means, such as adhesives, snap fittings or the like. The electrical contact modules 524 are electrically and conductively connected to the LED strip 520, and provide a means for supplying low voltage power to the individual LED's of the LED strip 520.

As particularly shown in FIG. 43, the electrical contact modules 524 (the left module 528 only is illustrated in FIG. 43) conductively abut a corresponding pair of low voltage power strips 534. The low voltage power strips 534 can be characterized as including a left power strip 536 and a right power strip 538. The power strips 534 are shown in several of the drawings, including FIGS. 42 and 43. The low voltage power strips 534 are preferably vertically disposed and extend along the longitudinal length of the corresponding cantilever ladders 504. In this manner, connection can be made to the low voltage power strips 534 independent of the particular height or level at which the shelving assembly 500 is positioned on the cantilever ladders 504. The low voltage power strips 534 are preferably fixedly attached to the rear wall of the refrigerator liner 502, through any suitable and well known means. It should also be noted that the low voltage power strips 534 are physically separate from the cantilever ladders 504. Further, although not shown in the drawings, the low voltage power strips 534 can be connected, for purposes of obtaining low voltage power, through other electrical apparatus within the refrigerator or other storage device. The other electrical apparatus may be self contained with respect to power or, alternatively, may obtain external power in any suitable manner.

For purposes of both mechanical and electrical connection of the electrical contact modules 524 to the corresponding power strips 534, the abutments between the modules 524 and the power strips 534 are made through a set of conductive spring-loaded noses 532. These noses 532 are shown, for example, in FIGS. 42 and 43. The spring loaded noses 532 provide for an adjustment of the distance between a side of an electrical contact module 524 and a corresponding power strip 534. In this manner, the electrical contact modules 524 facilitate overcoming width tolerance issues, when the entirety of the support structure of the shelving assembly 500 is placed into the ladder notches 510 of the cantilever ladders 504. That is, with the design of the contact modules 524 and the use of the spring loaded noses 532, width tolerance is provided which assures appropriate abutment of the contact modules 524 to the power strips 534. The electrical contact modules 524, module connectors 530, noses 532 and power strips 534 can be characterized as a "power supply assembly." The power supply assembly comprising these elements can be characterized as directly or indirectly conductively connecting the LED strip 520 to a supply of low voltage power. Further, the LED strip 520 can be characterized as a "first plurality of LEDs." Also, it should again be emphasized that the power strips 534 are located adjacent but separate from the cantilever ladders 504. Further, although the noses 532 are referred to as the "spring-loaded noses," it should be emphasized that components other than spring devices may be utilized to provide the function of the noses 532, without departing from the principal concepts of the invention. The noses 532 primarily must exhibit a function of resiliency, so as to extend and contract from the corresponding electrical contact module 524, in accordance with the distance between the contact module 524 and the corresponding low voltage power strip 534.

Figure 49:
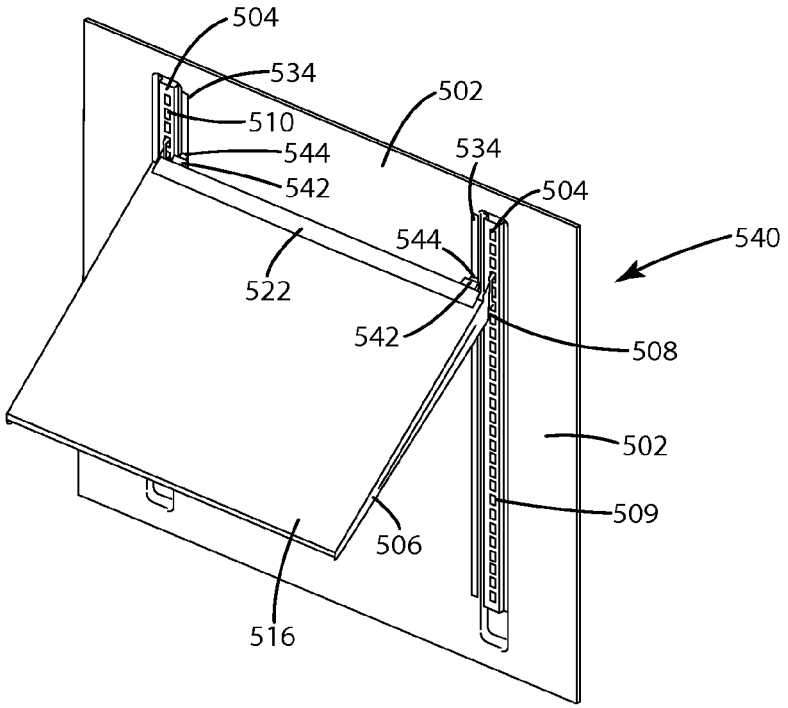
FIG. 49 is a perspective view of an alternative embodiment of a shelf assembly in accordance with the invention, with the electrical contact module on each side of the assembly having a different configuration than the modules shown in FIG. 40.
Figure 50:
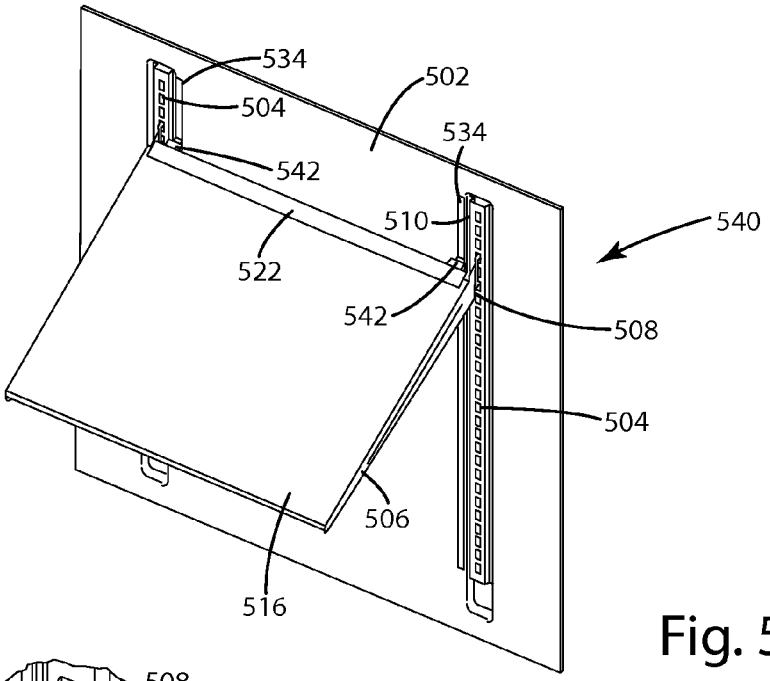
FIG. 50 is a perspective view similar to FIG. 49 of the shelf assembly shown therein.
Figure 51:
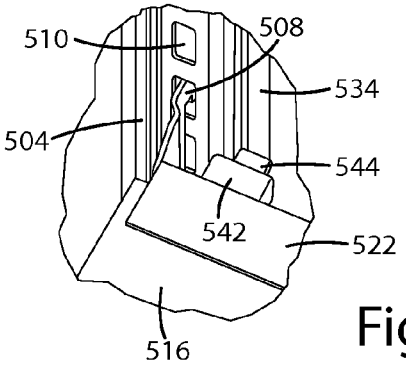
FIG. 51 is an enlarged view of one end of the shelf assembly shown in FIG. 49, showing the relative position of various elements.

A second embodiment of a shelving assembly in accordance with the invention is illustrated in FIGS. 49, 50 and 51, and is referred to herein as shelving assembly 540. For purposes of clarity and descriptiveness, elements in any given version of a shelving assembly in accordance with the invention as described herein which are substantially similar to or otherwise identical to elements previously described herein will be given identical reference numbers, and will not be described in detail. With reference to FIGS. 49-51, the shelving assembly 540, like the shelving assembly 500 previously described herein, can be used with a refrigerator liner 502 and cantilever ladders 504. Also, the shelving assembly 540 utilizes sheet metal sidearms 506 having ladder connectors 508. The ladder connectors 508 connect into ladder notches 510. A refrigerator shelf 516 is mounted to the sidearms 506 in a manner which can be identical to that previously described with respect to shelving assembly 500. The shelving assembly 540 utilizes an LED strip (not shown) corresponding exactly to the LED strip 520 previously described herein with respect to shelving assembly 500. A rear form 522 is also utilized. Also, the shelving assembly 540 is utilized with low voltage power strips 534 secured to the refrigerator liner 502.

In distinction to the shelving assembly 500, the shelving assembly 540 utilizes electrical contact modules 542 which have a configuration somewhat different from the configuration of the electrical contact modules 524 previously described herein with respect to shelving assembly 500. In this particular instance, the electrical contact modules 542 (one on each side of the rear form 522) extend directly rearwardly. Spring loaded noses 544 (or similar components having resilient properties as previously described herein with respect to the shelving assembly 500) also extend directly rearwardly from the corresponding contact modules 542, and abut the rear faces of the low voltage power strips 534. As with the previously described spring loaded noses 532 for the shelving assembly 500, the noses 544 provide for tolerance with respect to appropriate abutment of the low voltage power strips 534 with the electrical contact modules 542. It should also be noted that with respect to both of the shelving assemblies 500 and 540, an adhesive, other type of sealant or similar type of securing means may be utilized between the shelf 516 and the metal form 522. Also, it is possible for the low voltage power strips 534 used with the contact modules 542 to have a somewhat different configuration than the power strips used with contact modules 524. For example, the power strips 534 used with shelving assembly 540 may have flat surfaces positioned differently, so as to abut noses 544.

Figure 52:
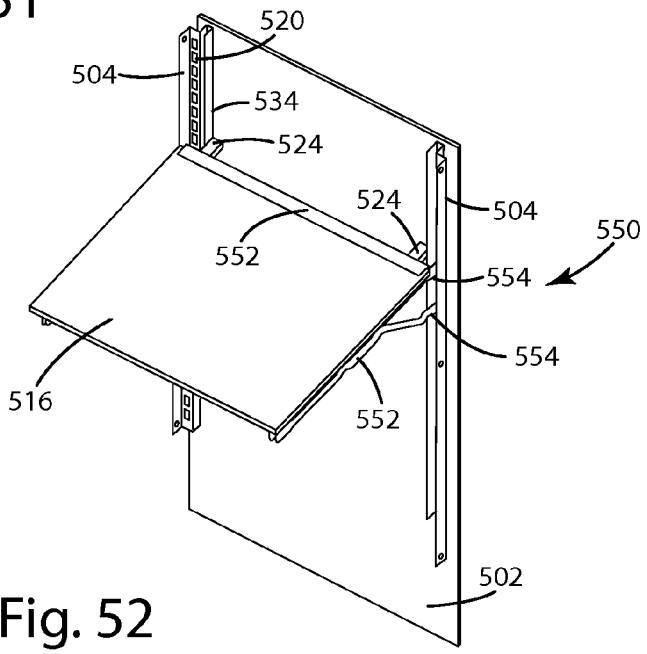
FIG. 52 is a further alternative embodiment of a shelf assembly in accordance with the invention, with the assembly utilizing wire sidearms and a slideout configuration for the shelf.
Figure 53:
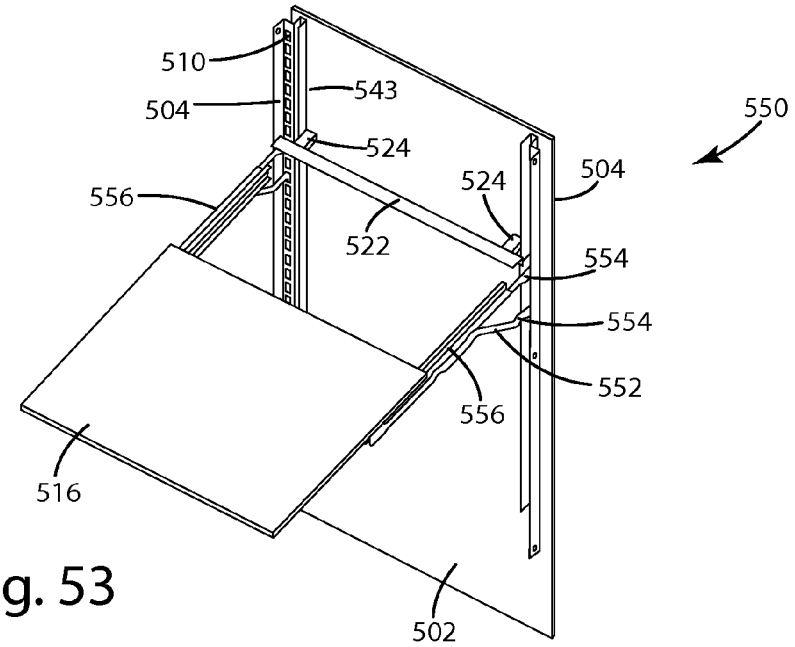
FIG. 53 is a perspective view similar to FIG. 52, but showing the shelf in an extended position.
Figure 54:
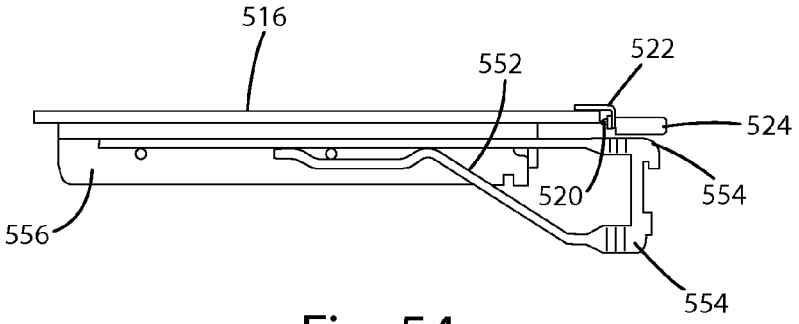
FIG. 54 is a partial side elevation view of the shelf assembly shown in FIG. 52.
Figure 55:
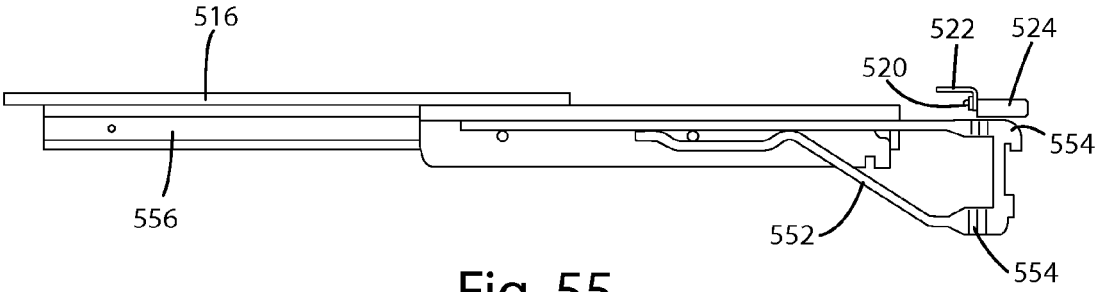
FIG. 55 is a partial side elevation view of the shelf assembly as shown in FIG. 53, with the shelf in an extended position.
Figure 56:
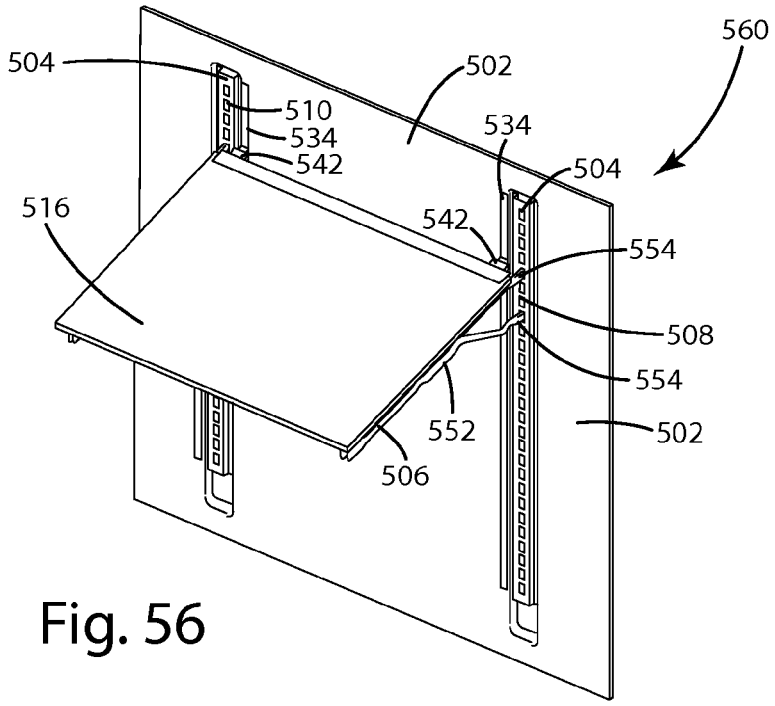
FIG. 56 is a still further embodiment of a shelf assembly in accordance with the invention, showing the assembly as having a pair of wire sidearms with a slideout configuration.

A still further embodiment of a shelving assembly in accordance with the invention is illustrated in FIGS. 52-55, and is described herein as shelving assembly 550. This particular shelving assembly 550, unlike the shelving assemblies 500 and 540, utilize a set of wire sidearms 552, in place of the sheet metal sidearms 506 previously described herein. Details regarding concepts associated with the use of wire sidearms have been previously described herein. As with the shelving assembly 500, the shelving assembly 550 is used with a refrigerator liner 502 and cantilever ladders 504. In place of sheet metal sidearms 506 and ladder connectors 508, the shelving assembly 550 includes a pair of wire sidearms 552, with corresponding ladder connectors 554. The ladder connectors 554 are adapted to be releaseably inserted into the ladder notches 510. The wire sidearms 552 can be secured in an appropriate and known manner to the refrigerator shelf 516. As with the shelving assembly 500, the shelving assembly 550 is illustrated as using a rear form 522 with electrical contact modules 524. The modules 524 are secured to the LED power strips 534 through spring loaded noses 532. Unlike the shelving assemblies 500 and 540, the rear form 522 is not secured to the shelf 516. The shelf 516 is appropriately secured to a pair of slide mechanisms 556 which are well known in the art. The slide mechanisms 556 permit the shelf 516 to be moved between extended and retracted positions. For example, FIGS. 52 and 54 illustrate the shelf 516 in a retracted position, while FIGS. 53 and 55 illustrate the shelf 516 in an extended position. An adhesive or similar material could be utilized to bond the shelf 516 to metal brackets on the side mechanisms 556, or directly to the slide mechanisms themselves as they are incorporated within the shelf support structure. Again, the shelving assembly 550 is utilized to illustrate the use of the invention comprising electrical contact modules 524 with the metal form 522 and LED strip 520 with the use of slidable or slideout embodiments of shelving assemblies.

Figure 57:
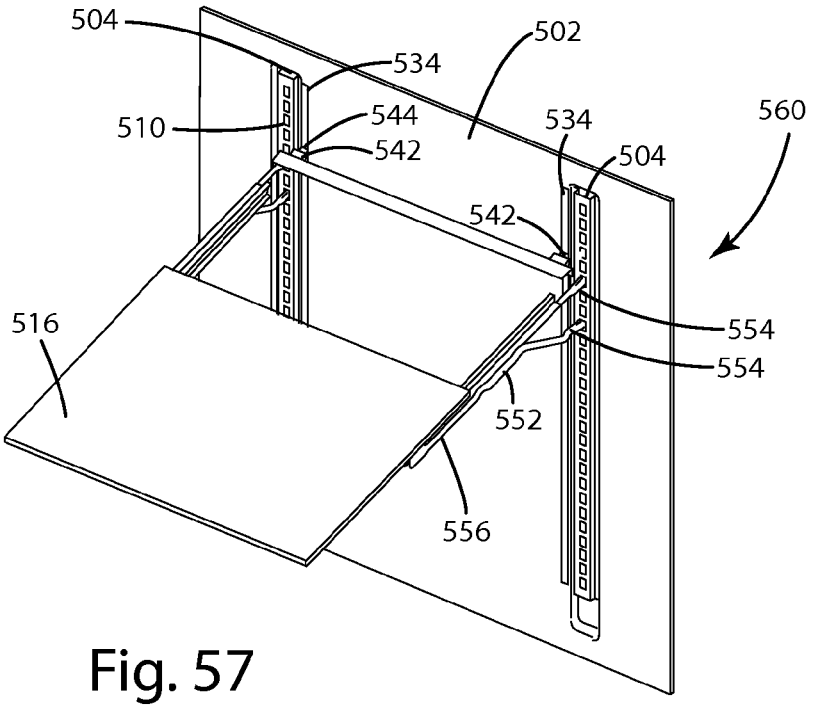
FIG. 57 is a perspective view similar to FIG. 56, but showing the shelf in an extended position.
Figure 58:
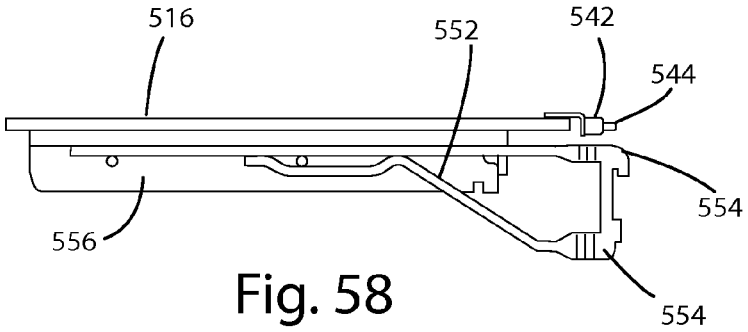
FIG. 58 is a partial side elevation view of the shelf assembly shown in FIG. 56.
Figure 59:
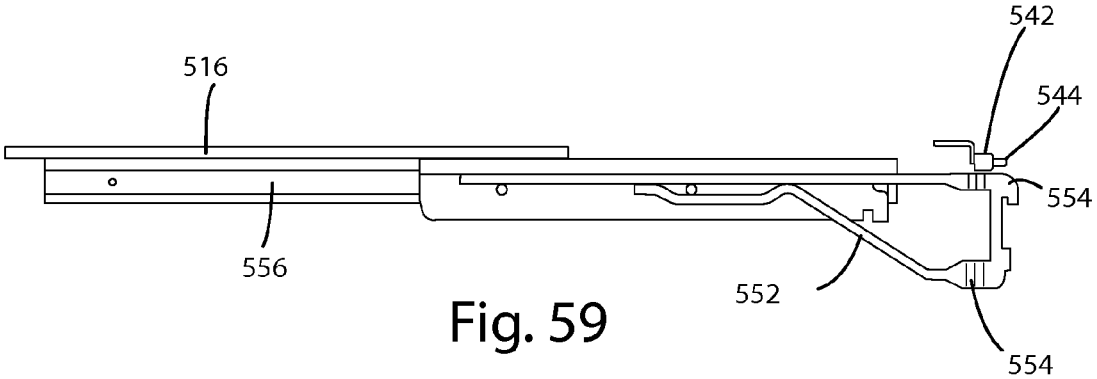
FIG. 59 is a partial side elevation view of the shelf assembly shown in FIG. 57, with the shelf in an extended position.

A still further embodiment of a shelving assembly in accordance with the invention is illustrated as shelving assembly 560 in FIGS. 56-59. Shelving assembly 560 utilizes the electrical contact modules 542 and spring loaded noses 544 as previously described as used with the shelving assembly 540. However, unlike the shelving assembly 540 which utilized the sheet metal sidearms 506, the shelving assembly 560 is somewhat similar to the shelving assembly 550, in that the assembly 560 utilizes wire sidearms 552 and slide mechanisms 556. Otherwise, the shelving assembly 560 is utilized with the refrigerator liner 502, the cantilever ladders 504 and ladder notches 510. The rear form 522 with the shelving assembly 560, as with the shelving assembly 550, is not attached to the shelf 516. In this manner, the shelf 516 is capable of moving between a retracted position (FIG. 56) and an extended position (FIG. 57). The shelving assembly 560 also utilizes the metal form 522 and the LED strip (not shown). Still further, the low voltage power strips 534 are also used.

Figure 60:
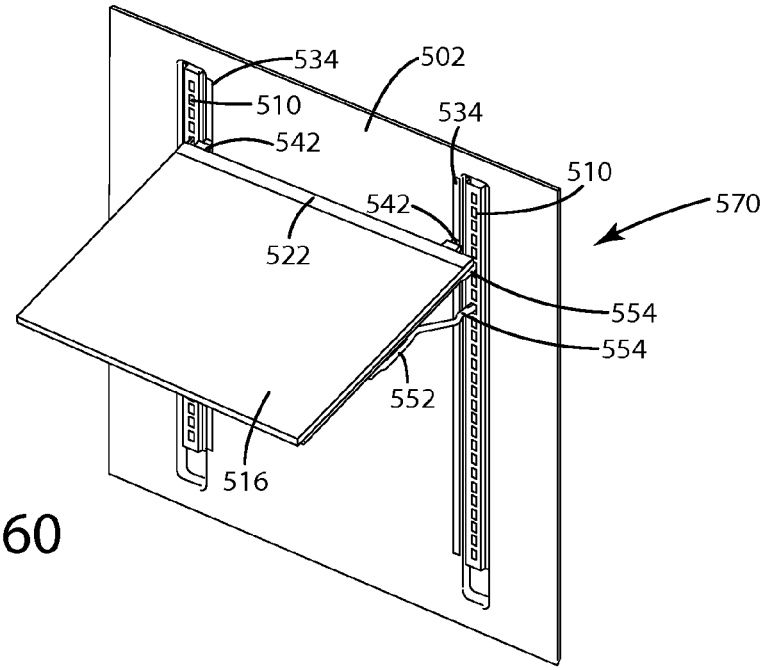
FIG. 60 is a further embodiment of a shelf assembly in accordance with the invention, utilizing wire sidearms and a stationary shelf.
Figure 61:
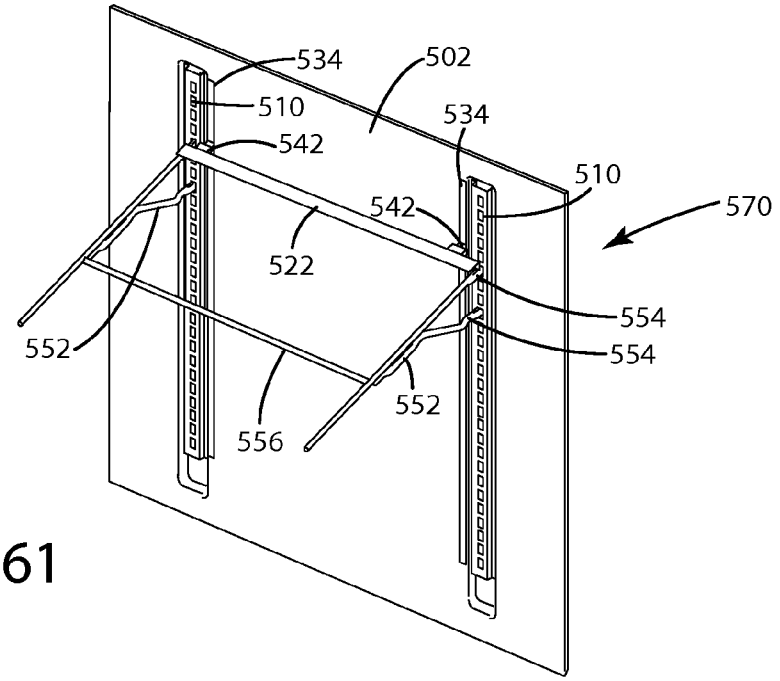
FIG. 61 is a partial, perspective view of the shelf assembly in FIG. 60, with the shelf removed.
Figure 62:
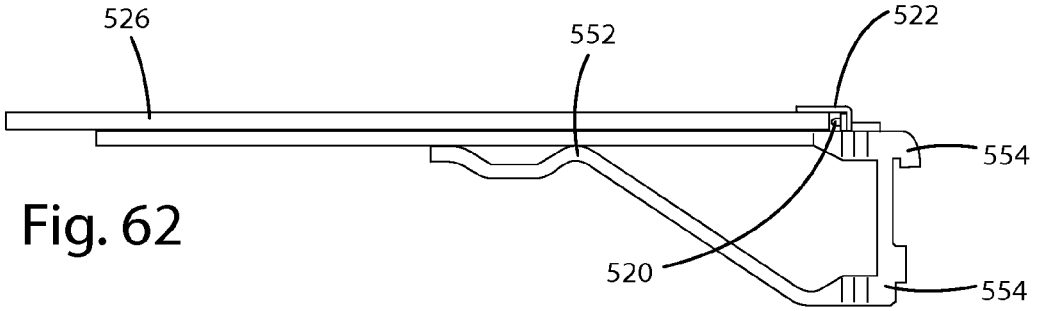
FIG. 62 is a right side elevation view of the shelf assembly shown in FIG. 60.

A still further embodiment of a shelving assembly in accordance with the invention is illustrated in FIGS. 60, 61 and 62 as shelving assembly 570. The shelving assembly 570 utilizes the electrical contact modules 542 used with the shelving assembly 540 (and with the spring loaded noses 544), but with the wire sidearms 552 used with the shelving assembly 550. Otherwise, the shelving assembly 570 is used with the refrigerator liner 502, cantilever ladders 504 and ladder notches 510. An LED strip 520 is also used, as well as a metal form 522. With the assembly 570, the metal form 522 can be adhesively bonded to the shelf 516, in that the shelf 516 is stationary. The shelving assembly 570 is also utilized with the low voltage power strips 534.

Figure 63:
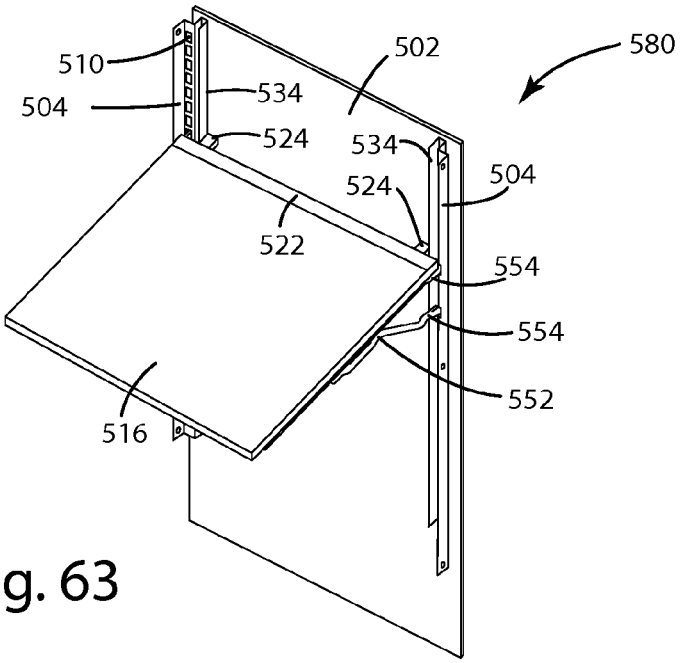
FIG. 63 is a perspective view of a still further embodiment of a shelf assembly in accordance with the invention, showing the use of a pair of wire sidearms, with the shelf having a stationary configuration.
Figure 64:
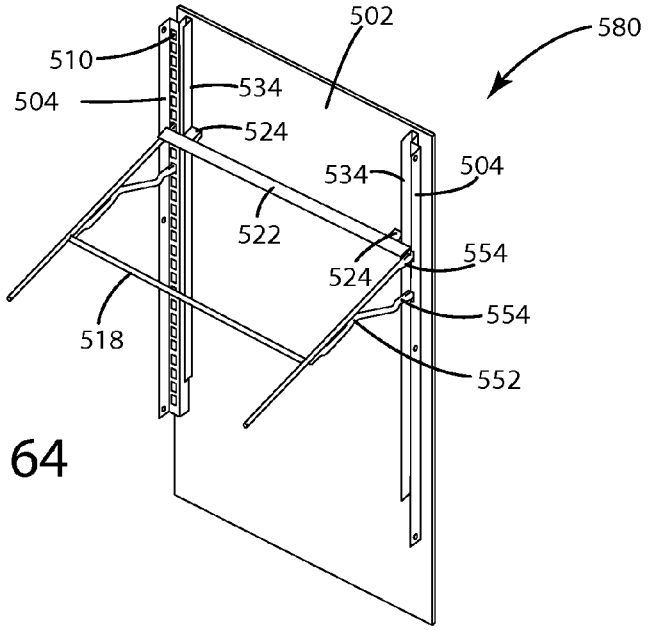
FIG. 64 is a perspective view similar to FIG. 61, showing the shelf assembly of FIG. 63 with the shelf removed.
Figure 65:
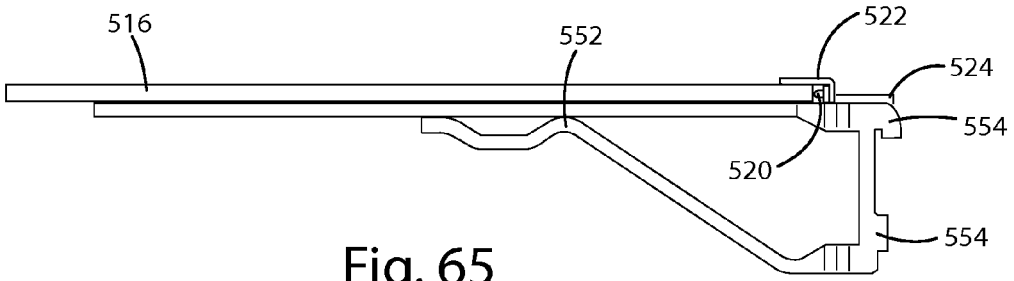
FIG. 65 is a partial right side elevation view of the shelf assembly shown in FIG. 63.

Another embodiment of a shelving assembly in accordance with the invention is illustrated in FIGS. 63, 64 and 65 as shelving assembly 580. In this particular instance, the shelf 516 is stationary, and uses the wire sidearms 552 described previously herein with respect to shelving 550. The sidearms 552 also utilize the ladder connectors 554. However, unlike the shelving assembly 550 which utilizes slide mechanisms, the shelf 516 is stationary and uses the electrical contact modules 524 and spring loaded noses 532 (the noses 532 are not shown in any detail in FIGS. 63, 64 and 65), in a manner similar to the shelving assembly 500.

Various embodiments of shelving assemblies in accordance with the invention have been described. In addition to these shelving assemblies, it is also worthwhile to consider various means for enhancing "spill resistant" or "spill safe" configurations for the shelves 516. That is, various types of means are often used for refrigerator shelves so as to prevent liquid or similar materials which form on shelves 516 from dripping or otherwise leaking down to other shelves or other areas of the refrigerator or other storage space. One concept in accordance with a certain aspect of the invention relates to the utilization of a superhydrophobic treatment so as to provide for a particular type of coating on the top surface of the shelf 516. This coating can be utilized so as to retain more liquids on the shelf 516 itself, as opposed to existing designs.

Various embodiments of shelving assemblies in accordance to the invention have now been described in detail herein. All of the shelving assemblies herein utilize LEDs so as to provide a relatively lower cost energy source for light. It should be noted that with respect to shelving assemblies utilizing the wire sidearms 552 or similar materials, the metal form 522 can be welded or otherwise directly secured to the wire sidearms 552. Utilization of wire sidearms may provide improved light transmission, as opposed to the use of sheet metal sidearms 506. In the embodiments of the shelving assemblies, two separate embodiments of configurations of electrical contact modules and low voltage power strips have been illustrated. The configurations of the electrical contact modules with the LED strips provides additional usable shelf space, relative to known systems. Further, shelving assemblies in accordance with the invention provide for improved lighting within a storage space, and energy efficiency improvement within devices such as refrigerators. Also, the LED strips and the metal forms, along with other concepts described herein with respect to the shelving assemblies, provide for relatively easy assembly, and have less complicated design requirements for the LED shelves. Less material is required for manufacture and, as previously described herein, the shelving assemblies in accordance with the invention allow for tolerance variation within the refrigerator liner and assembly operations. Further, existing cantilever ladders or other track shelves support designs do not have to be modified to use shelves, LED strips or metal forms in accordance with the invention.

It will apparent to those skilled in the pertinent arts that other embodiments in accordance with the invention may be designed. That is, the principles of shelving assemblies in accordance with the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

What is claimed is:

1. A shelf assembly adapted for use in a refrigerator and other articles, said shelf assembly comprising:

a shelf;

support means for supporting said shelf at a desired height;

securing means for securing said shelf to said support means;

a first plurality of LEDs positioned in proximity to said shelf; and a power supply assembly directly or indirectly conductively connected to said first plurality of LEDs for supplying low voltage power to individual ones of said first plurality of LEDs;

said first plurality of LEDs is formed as an LED strip located adjacent a rear portion of said refrigerator shelf;

a rear form for securing said LED strip;

at least one electrical contact module positioned adjacent to said LED strip;

at least one low voltage power strip, said low voltage power strip conductively abutting said electrical contact module; and a set of electrical conductive contacts positioned between said electrical contact module and said power strip, said conductive contacts extending rearward from said shelf assembly and conductively abutting said low voltage power strip.

2. A shelf assembly in accordance with claim 1, wherein said electrical conductive contacts comprises resilient means for permitting differing distances between components of said power supply assembly.

3. A shelf assembly in accordance with claim 1, wherein said power supply assembly comprises:

a pair of said electrical contact modules directly or indirectly conductively connected to said first plurality of LEDs; and a pair of said low voltage power strips, each of said power strips conductively abutting different ones of said pair of electrical contact modules.

4. A shelf assembly in accordance with claim 3, wherein said abutments of said power strips with different ones of said pair of electrical contact modules is provided through a pair of resilient components positioned between said power strips and said different ones of said pair of electrical contact modules.

5. A shelf assembly in accordance with claim 4, wherein said resilient means comprise a pair of spring loaded noses which provide width tolerances between said power strips and said electrical contact modules.

6. A shelf assembly in accordance with claim 3, wherein said pair of power strips are located adjacent to, but separate from any components of said support means.

7. A shelf assembly in accordance with claim 1, wherein: said first plurality of LEDs is formed as an LED strip; and said LED strip is secured to a rear form.

8. A shelf assembly in accordance with claim 1, wherein said power supply assembly comprises a pair of said low voltage power strips, each of said power strips being vertically disposed and positioned on a rear portion of said refrigerator or other article.

9. A shelf assembly in accordance with claim 8, wherein said low voltage power strips are structured and configured so that an electrically conductive direct or indirect connection can be made between said low voltage power strips and said first plurality of LEDs independent of any particular height or level at which said shelf is supported by said support means.

10. A shelf assembly in accordance with claim 1, wherein said assembly further comprises a superhydrophobic coating which can be placed on a portion of a surface of said shelf, so as to retain spillage of water or other liquid.

11. A shelf assembly in accordance with claim 1, wherein said support means comprises:

a pair of cantilever ladders having ladder notches; and a pair of sidearms positioned on opposing sides of said shelf and having rearwardly projecting ladder connectors adapted to be releasably secured into sets of said ladder notches.

12. A shelf assembly in accordance with claim 11, wherein said securing means comprises an adhesive for bonding said shelf to said sidearms.

13. A shelf assembly in accordance with claim 1, wherein said power supply assembly comprises:

a pair of said electrical contact modules positioned adjacent opposing ends of said LED strip, and having module connectors coupled to said rear form, with said electrical contact modules being conductively connected to said LED strip;

a pair of said low voltage power strips, each of said power strips conductively abutting different ones of said electrical contact modules, said low voltage power strips being vertically disposed and separate from said cantilever ladders, said low voltage power strips further being attached to a rear portion of said refrigerator or other article; and said electrical conductive contacts comprise a set of conductive and spring-loaded noses positioned between said electrical contact modules and corresponding ones of said power strips, for providing an adjustment of distance between one of said electrical contact modules and a corresponding one of said power strips.

14. A shelf assembly in accordance with claim 13, wherein said spring-loaded noses extend directly rearward from corresponding ones of said electrical contact modules, and abut rear faces of said low voltage power strips.

15. A shelf assembly in accordance with claim 13, wherein:

said shelf assembly further comprises a set of slide mechanisms for permitting said shelf to be moved between extended and retracted positions; and said rear form and said LED power strip are maintained stationary while said shelf is moved between said extended and retracted positions.

16. A shelf assembly in accordance with claim 1, wherein said support means comprises a pair of sheet metal sidearms.

17. A shelf assembly in accordance with claim 1, wherein said support means comprises a pair of wire sidearms.

18. A shelf assembly adapted for use in a refrigerator and other articles, said shelf assembly comprising:

a shelf;

support means for supporting said shelf at a desired height;

securing means for securing said shelf to said support means;

a first plurality of LEDs;

a power supply assembly directly or indirectly conductively connected to said first plurality of LEDs for supplying low voltage power to individual ones of said first plurality of LEDs;

said first plurality of LEDs is formed as an LED strip located adjacent a rear of said refrigerator shelf;

a rear form for securing said LED strip;

said power supply assembly further comprises:

a pair of electrical contact modules positioned adjacent opposing ends of said LED strip, and having module connectors coupled to said rear form, with said electrical contact modules being conductively connected to said LED strip;

a pair of low voltage power strips, each of said power strips conductively abutting different ones of said electrical contact modules, said low voltage power strips being vertically disposed and separate from cantilever ladders, and said low voltage power strips being further attached to a rear portion of said refrigerator or other article;

resilient means positioned between said electrical contact modules and corresponding ones of said power strips, for providing an adjustment of distance between one of said electrical contact modules and a corresponding one of said power strips; and said resilient means extends directly rearward from corresponding ones of said electrical contact modules, and conductively abut said low voltage power strips.

19. A shelf assembly in accordance with claim 18, wherein said resilient means comprises a set of conductive and spring loaded noses positioned between said electrical contact modules and corresponding ones of said power strips.

* * * * *